US007387402B1

(12) United States Patent
Lui (Phillip)

(10) Patent No.: US 7,387,402 B1
(45) Date of Patent: Jun. 17, 2008

(54) MULTIPLE LIGHT LED FLASHLIGHT

(76) Inventor: Chun Wai Lui (Phillip), 5 Willowridge, Irvine, CA (US) 92602

( * ) Notice: Subject to any disclaimer, the term of this patent is extended or adjusted under 35 U.S.C. 154(b) by 33 days.

(21) Appl. No.: 11/125,784

(22) Filed: May 10, 2005

Related U.S. Application Data

(63) Continuation-in-part of application No. 10/987,890, filed on Nov. 12, 2004, now abandoned.

(60) Provisional application No. 60/519,691, filed on Nov. 13, 2003.

(51) Int. Cl.
*F21V 33/00* (2006.01)

(52) U.S. Cl. ..... 362/196; 362/191; 362/180; 362/199; 362/640; 362/656

(58) Field of Classification Search ..... 362/184, 362/183, 191, 237, 294, 800, 373
See application file for complete search history.

(56) References Cited

U.S. PATENT DOCUMENTS

| | | | | |
|---|---|---|---|---|
| 4,929,866 | A | 5/1990 | Murata et al. | |
| 5,317,490 | A | 5/1994 | Miller | |
| 5,318,177 | A | 6/1994 | Isacson | |
| 5,561,346 | A | 10/1996 | Byrne | |
| 5,586,819 | A | 12/1996 | Bamber et al. | |
| 5,642,933 | A | 7/1997 | Hitora | |
| 6,012,820 | A * | 1/2000 | Weber et al. | 362/19 |
| 6,033,087 | A | 3/2000 | Shozo et al. | |
| 6,039,456 | A | 3/2000 | Chabria | |
| 6,076,948 | A | 6/2000 | Bukosky et al. | |
| 6,158,875 | A | 12/2000 | Olivit et al. | |
| 6,168,288 | B1 | 1/2001 | St. Claire | |
| 6,183,106 | B1 | 2/2001 | Thummel et al. | |
| 6,190,020 | B1 | 2/2001 | Hartley | |
| 6,234,646 | B1 | 5/2001 | Ito | |
| 6,238,073 | B1 | 5/2001 | Ito et al. | |
| 6,273,586 | B1 | 8/2001 | Schuloff | |
| 6,334,235 | B2 | 1/2002 | Duperray et al. | |
| 6,364,506 | B1 | 4/2002 | Gallo | |
| 6,380,864 | B1 | 4/2002 | Richard | |
| 6,402,340 | B1 | 6/2002 | Sharrah et al. | |
| 6,447,155 | B2 | 9/2002 | Kondo et al. | |
| 6,474,852 | B1 | 11/2002 | Ohkohdo et al. | |
| 6,485,160 | B1 | 11/2002 | Sommers et al. | |
| 6,502,956 | B1 | 1/2003 | Wu | |

(Continued)

OTHER PUBLICATIONS

Glow in the dark powder; website http://archive.org/web/20031218215920/readysetglo.com; 2 pages.

(Continued)

*Primary Examiner*—Sandra O'Shea
*Assistant Examiner*—Anabel M. Ton
(74) *Attorney, Agent, or Firm*—Knobbe, Martens, Olson & Bear, LLP

(57) ABSTRACT

A multiple lens LED flashlight is disclosed and comprises a quick release opening mechanism combined with a slow release battery mechanism for easy replacement of batteries. A reverse tapered handle provides a secure grip and ensures proper and safe use of the multiple lens LED flashlight. Various different lens designs refract light emitted from the LEDs and create one or more of a wide angle of projected light as well as concentrated narrow beam of light.

20 Claims, 23 Drawing Sheets

U.S. PATENT DOCUMENTS

| | | | | |
|---|---|---|---|---|
| 6,517,215 | B2 | 2/2003 | Mele | |
| 6,523,977 | B2 | 2/2003 | Chuang et al. | |
| 6,547,414 | B2 | 4/2003 | Steger | |
| 6,857,756 | B2 * | 2/2005 | Reiff et al. | 362/184 |
| 6,942,362 | B1 * | 9/2005 | Deutsch et al. | 362/253 |
| 7,131,759 | B2 * | 11/2006 | Ishida et al. | 362/545 |
| 2002/0014862 | A1 | 2/2002 | Fregoso | |
| 2002/0018343 | A1 | 2/2002 | Steger | |
| 2002/0057567 | A1 | 5/2002 | Chen | |
| 2002/0114154 | A1 | 8/2002 | Galli | |
| 2002/0114157 | A1 | 8/2002 | Chuang et al. | |
| 2002/0136006 | A1 | 9/2002 | Altman | |
| 2002/0149928 | A1 | 10/2002 | Watterson et al. | |
| 2002/0191395 | A1 | 12/2002 | Fleury | |
| 2002/0191396 | A1 | 12/2002 | Reiff et al. | |

OTHER PUBLICATIONS

OddOne's White LED Information—Review: Fraen Optical Collimators for Luxeon LEDs; website http://www.e-f-w.com/community/modules.php?name=News&file=ar...; 5 pages.

Fraen_optics_overview.jpg; website: http://e-f-w.com/community/images/content/review_fraen_opti...; 1 page.

Fraen_optics_width.jpg website: http://e-f-w.com/community/images/content/review_fraen_opti...; 1 page.

Fraen_optics_height.jpg website: http://e-f-w.com/community/images/content/review_fraen_opti...; 1 page.

Fraen_optics_elliptical.jpg website: http://e-f-w.com/community/images/content/review_fraen_opti...; 1 page.

Fraen_optics_wide.jpg website: http://e-f-w.com/community/images/content/review_fraen_opti...; 1 page.

Fraen_optics_medium.jpg; website: http://e-f-w.com/community/images/content/review_fraen_opti...; 1 page.

Fraen_optics_narrow.jpg website: http://e-f-w.com/community/images/content/review_fraen_opti...; 1 page.

Fraen_optics_narrow_on_led.jpg: website: http://e-f-w.com/community/images/content/review_fraen_opti...; 1 page.

GlowInc.com; Glow in the Dark Powder and Pigment; http://www.gloinc.com/pigment.htm; 2 pages.

* cited by examiner

MULTIPLE LIGHT LED FLASHLIGHT

RELATED APPLICATIONS

This application is a continuation-in-part application of U.S. patent application Ser. No. 10/987,890, which was filed on Nov. 12, 2004, now abandoned which claims the priority benefit under 35 U.S.C. § 119(e) of U.S. Provisional Patent Application No. 60/519,691, filed on Nov. 13, 2003, each of which is hereby incorporated by reference in its entirety.

BACKGROUND OF THE INVENTION

1. Field of the Invention

The present invention relates generally to lenses used in conjunction with light emitting diodes. One application of the lenses is a battery-powered hand-held flashlight having at least one light emitting diode (LED).

2. Description of the Related Art

In recent years, light emitting diodes (LED) have been used as a light source for flashlights. LED have an advantageously power draw and are desired for at least that reason. In addition, LED's have a substantially longer life when compared to bulbs used as light sources in earlier flashlights.

Although LED flashlights offer these advantages over incandescent bulb flashlights, a need exists for further improvements to the current LED flashlights to increase brightness, comfort, as well as ease of use.

SUMMARY OF THE INVENTION

Accordingly, one aspect of the present invention involves a multiple light LED flashlight comprising an elongate tubular housing and a bulb housing. A quick disconnect mechanism is positioned between the tubular housing and the bulb housing. The tubular housing defines a chamber sized and configured to receive at least one battery. The quick disconnect mechanism is adapted to provide access to the chamber by removal of the bulb housing from an end of the tubular housing. The bulb housing comprises an outer shell member and a lower shell member that are secured together. A housing is positioned within a region defined between the outer shell member and the lower shell member. A lens assembly is positioned generally between the housing and the outer shell member. The lens assembly comprises a plurality of lenses that are integrally formed. A plurality of LED's extend through a portion of the housing and are generally aligned with a respective lens of the lens assembly.

BRIEF DESCRIPTION OF THE DRAWINGS

Several features, aspects and advantages of the present invention will now be described with reference to the drawings of several preferred embodiments, which embodiments are intended to illustrate and not to limit the invention.

DETAILED DESCRIPTION OF THE PREFERRED EMBODIMENT

Figure 1:
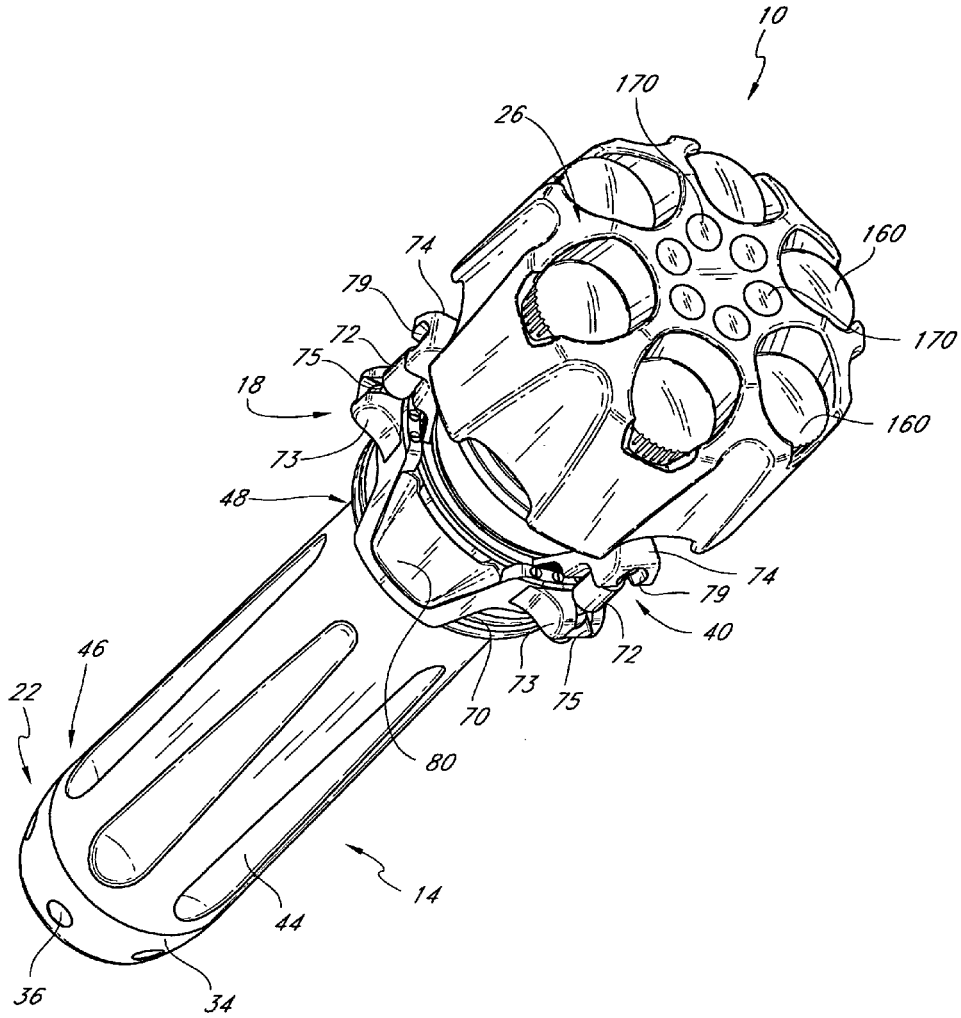
FIG. 1 is a side perspective view of an LED flashlight arranged and configured in accordance with certain features, aspects and advantages of a preferred embodiment of the present invention.
Figure 2:
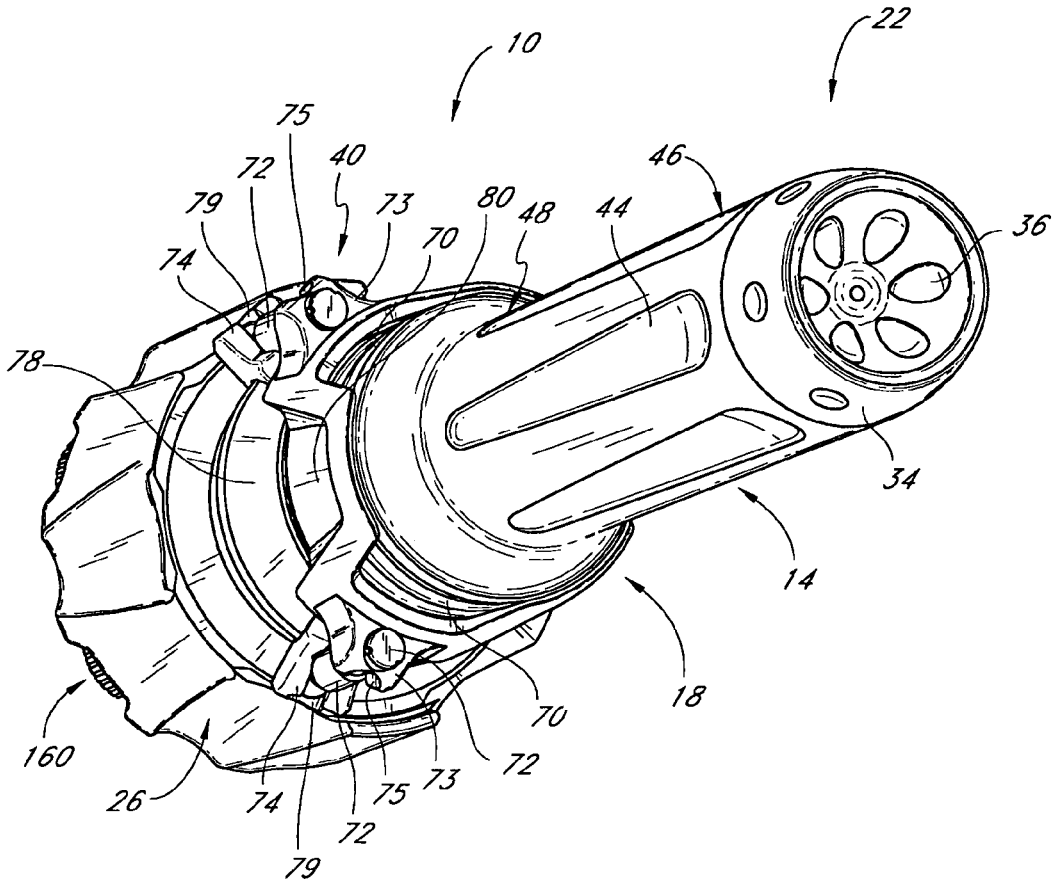
FIG. 2 is another side perspective view of the flashlight of FIG. 1.

With reference to FIGS. 1-2 an overall view of a multiple LED flashlight 10 is shown. The flashlight 10 comprises a tapered, elongated tubular housing 14 made of any suitable material such as, but not limited to, aluminum or plastic. The illustrated elongated housing 14 extends between a large end 18 and a small end 22.

At the large end 18 is a bulb housing 26 that can include at least one LED. The LED's can have any desired size, shape and color. In one configuration, the LED's are 120 degree LED's. The bulb housing 26 is removable to allow the installation of at least one battery 30 (FIG. 5) into the elongated housing 14. The bulb housing 26 can be formed of any suitable material, including but not limited to metals and a polycarbonate materials. A small cover 34 comprising holes 36 is at the small end 22. The bulb housing 26 and small cover 34 enclose an inner cavity of the elongated housing 14. The cavity contains the batteries 30. Below the bulb housing 26 is a quick release mechanism 40 (FIGS. 1-3) that allows the quick removal of the bulb housing 26 to easily and quickly change batteries when necessary or desired.

The outer surface of the elongated housing 14 can comprise indented ribs 44 along at least a portion of the elongated body. The illustrated elongated housing 14 includes a tapered shape that begins with a large diameter circumference 46 where the small cover 34 is attached and extends to a small diameter circumference 48 below the quick release mechanism 40. Thus, the illustrated elongated housing 14 comprises a smaller diameter portion proximate the large end 18 of the flashlight 10 and a larger diameter portion proximate the small end 22. This tapered shape is formed to increase the gripping characteristics of the illustrated flashlight 10. While the flashlight 10 is advantageously well balanced, the elongated housing 14 being tapered from the small diameter circumference 48 near the area of the quick release mechanism 40 to the large diameter circumference 46 near the small cover 34 prevents the flashlight from inadvertently slipping out of the user's hands.

Figure 3:
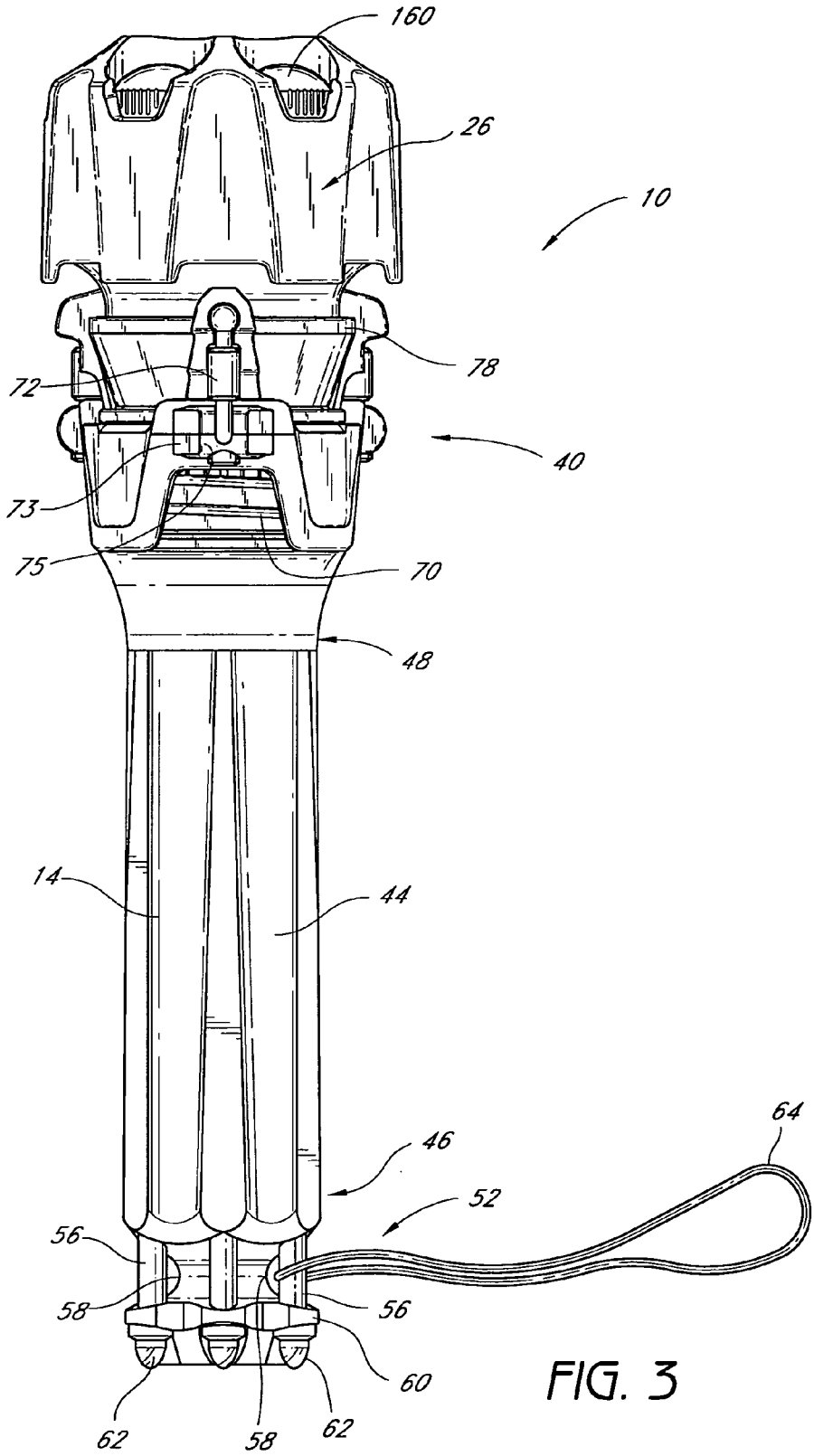
FIG. 3 is a side elevation view of another flashlight that is arranged and configured in accordance with certain features, aspects and advantages of a preferred embodiment of the present invention.
Figure 4:
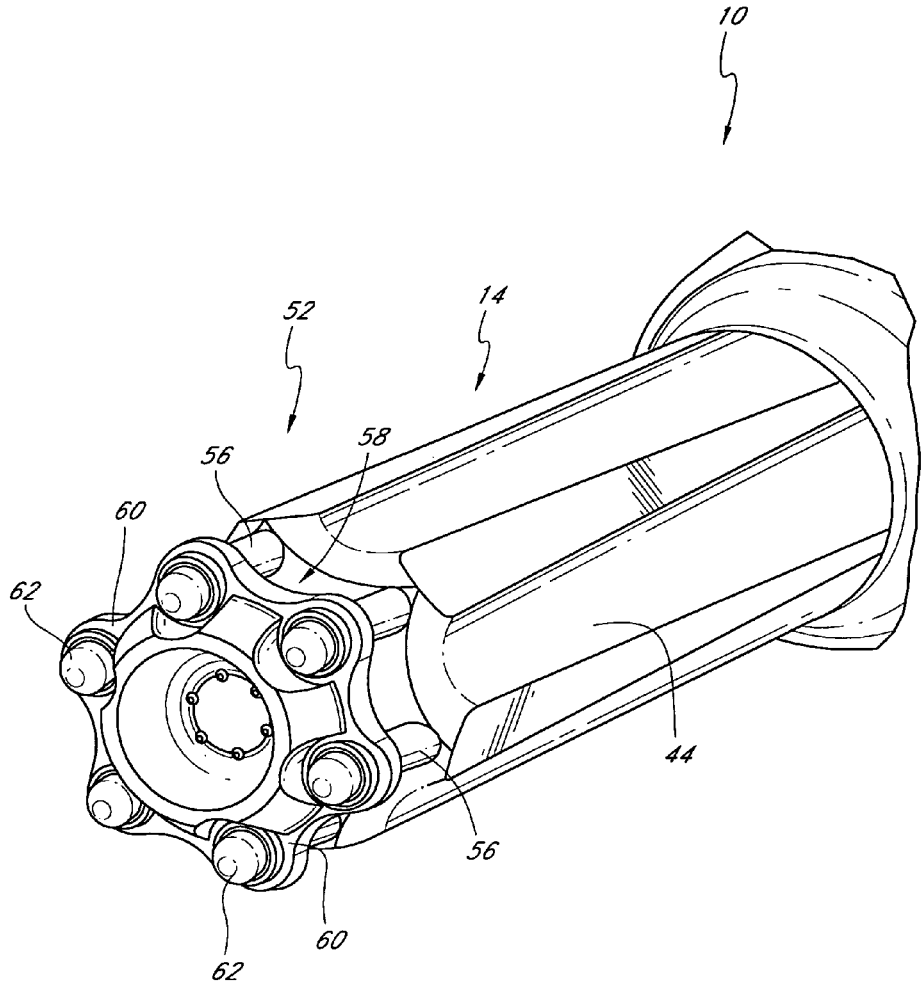
FIG. 4 is a perspective view of a portion of the flashlight of FIG. 3.

FIGS. 3 and 4 illustrate another flashlight 10 that is very similar to the flashlight shown in FIG. 1. The elongated body of the flashlight 10 shown in FIG. 3 comprises a smaller end 52 that includes a plurality of pins 56 surrounding a narrow recess 58. Advantageously, the ends of both the arrangement of FIG. 1 and the arrangement of FIG. 3 allow the flashlight to easily stand on its tail unassisted such that the flashlight can be used in a manner similar to a candle to illuminate an enlarged area surrounding the location of the flashlight.

The pins 56 can be attached to the elongated housing 14 through for example, but not limited to, a press fit, threaded holes, or glue. The pins 56 extend through an end piece 60 of the elongated housing 14 forming a plurality of protruding rod tips 62. The tips 62 can be hardened or coated with a material. FIG. 4 illustrates the smaller end 52 of the flashlight 10, including the protruding pins, in greater detail. The plurality of pins 56 along with the recess 58 allows for a lanyard 64 or other possible attachment to be fastened to one or more of the pins 56. The protruding rod tips 62 allow the flashlight 10 of FIG. 3 to be used in a variety of ways, such as, for example, to break automotive glass in an emergency situation.

Figure 5:
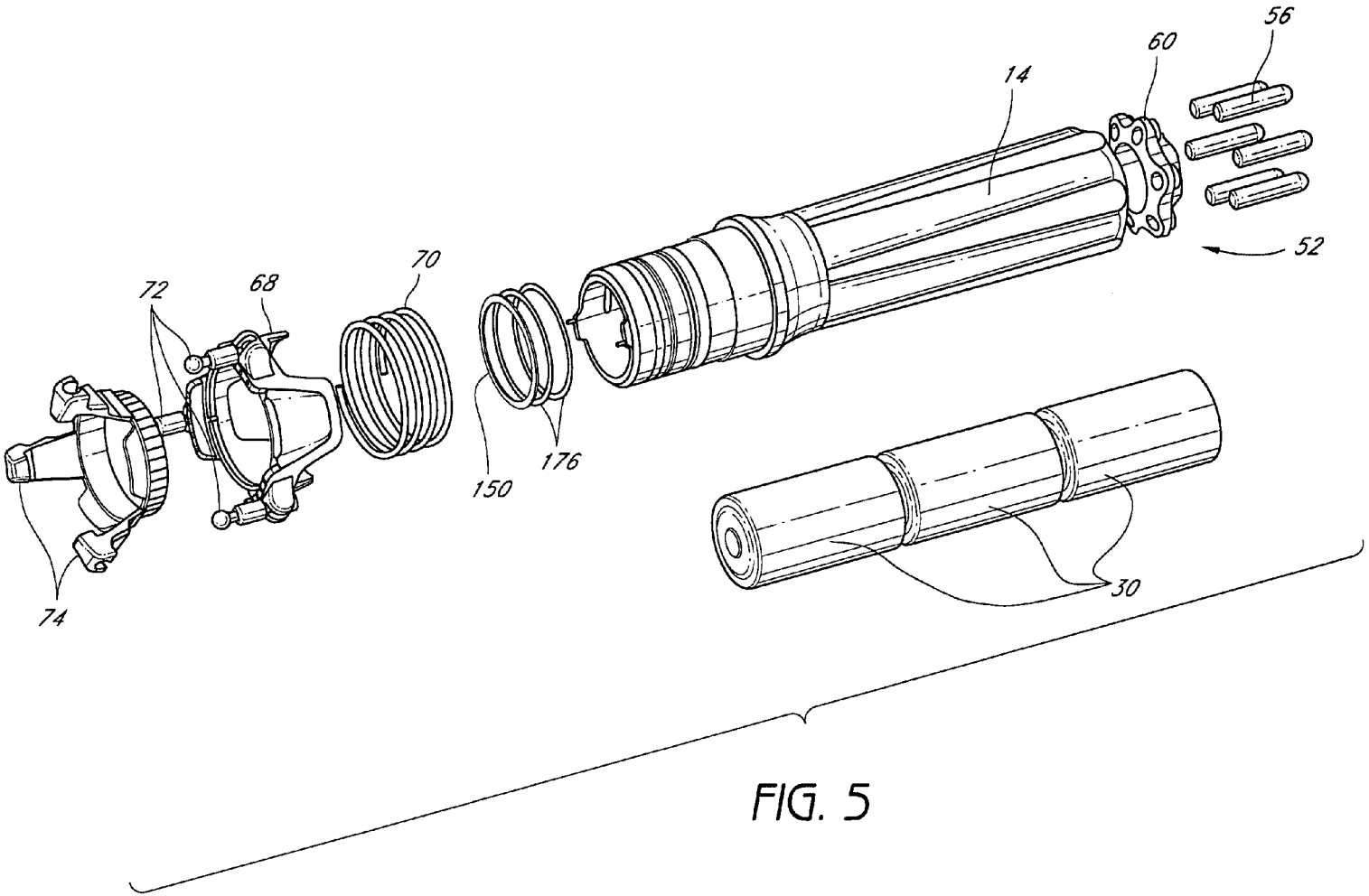
FIG. 5 is an exploded view of a handle portion of the flashlight of FIG. 3.
Figure 13:
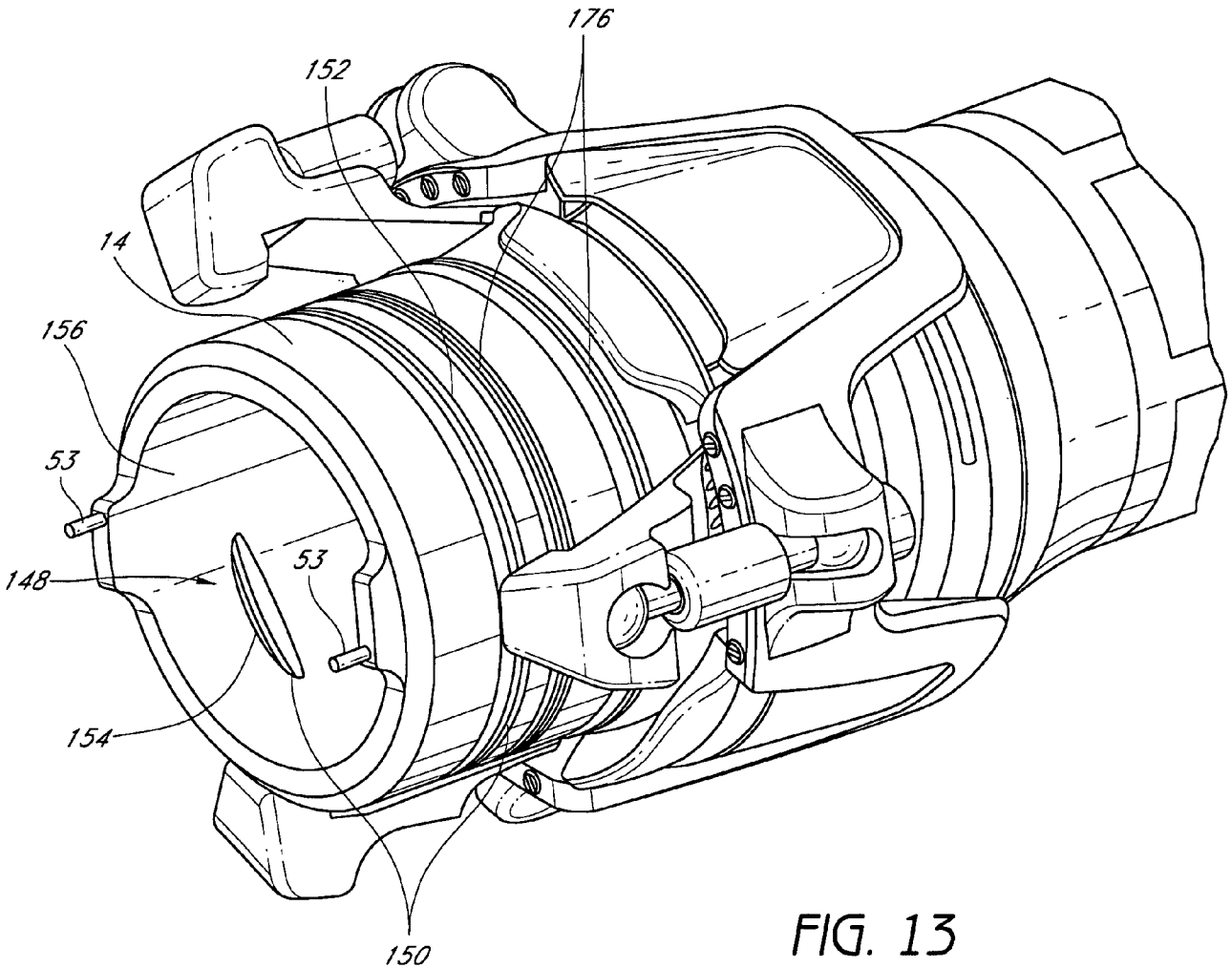
FIG. 13 is a perspective view of a slow battery release device, which is arranged and configured in accordance with certain features, aspects and advantages of a preferred embodiment of the present invention that can be employed with the flashlight of FIG. 1 or FIG. 3.

With reference to FIG. 5, a portion of the flashlight 10 of FIG. 3 is shown in exploded view. The batteries 30 shown in FIG. 5 can be inserted into the elongated housing 14 and preferably are arranged in series relation. Although sufficient space is provided for three batteries in the elongated housing 14, the housing 14 can be configured to accommodate any number of batteries depending on the voltage required for proper operation of the flashlight. The battery closest to the end piece 60 at the small end 52 of the elongated housing 14 has a terminal (not shown) that engages a contact (not shown). While not illustrated, in one embodiment the contact is formed by a generally J-shaped wire that is embedded within the housing 14 during molding such that the wire forming the contact is substantially encased within the material forming the housing 14. With reference to FIG. 13, two wires 53 are illustrated therein. These wires 53 are the uppermost portions of the wires that are embedded in the material of the housing 14 and that define the contact at a lower portion of the housing. The wires 53 are in electrical communication with circuit boards, described below, when the bulb housing 26 is secured to the housing 14.

Various different embodiments of quick release mechanisms are possible; some of which will be explained in greater detail below. Most preferred embodiments of quick release mechanisms provide a fast, easy way to replace the batteries in the flashlight 10. Although the batteries used to energize low power consuming LED last for a long time, when the batteries 30 do need removing and/or replacing, the quick release mechanisms allow the user to replace the batteries quickly and easily.

Figure 6:
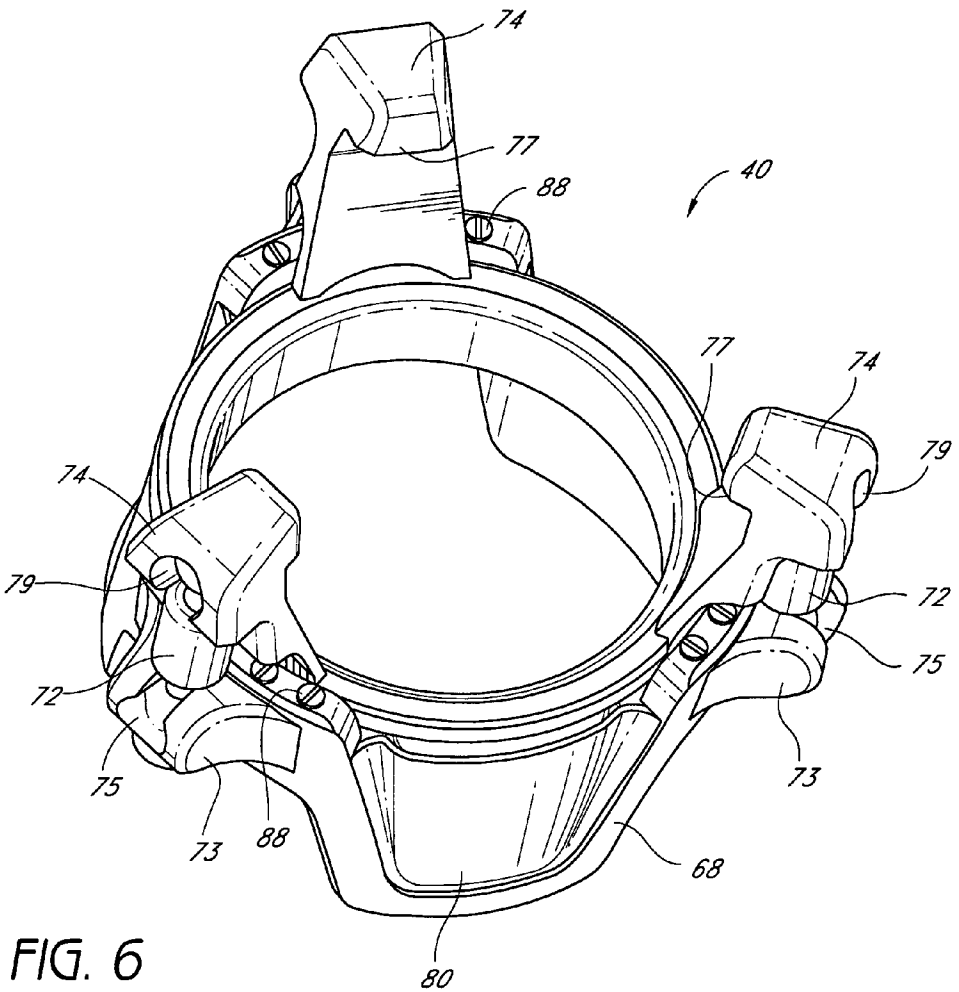
FIG. 6 is an enlarged perspective view of a quick release mechanism used in the flashlight of FIG. 1 or FIG. 3.

One embodiment of a quick release mechanism is shown in detail in FIGS. 6-9. FIG. 6 illustrates an assembly of parts that comprise one embodiment of a quick release mechanism that is arranged and configured in accordance with certain features, aspects and advantages of the present invention. The illustrated assembly generally comprises a collar 68, a spring 70 (see FIG. 5), a plurality of connecting arms 72, and a plurality of clamps 74.

Figure 7:
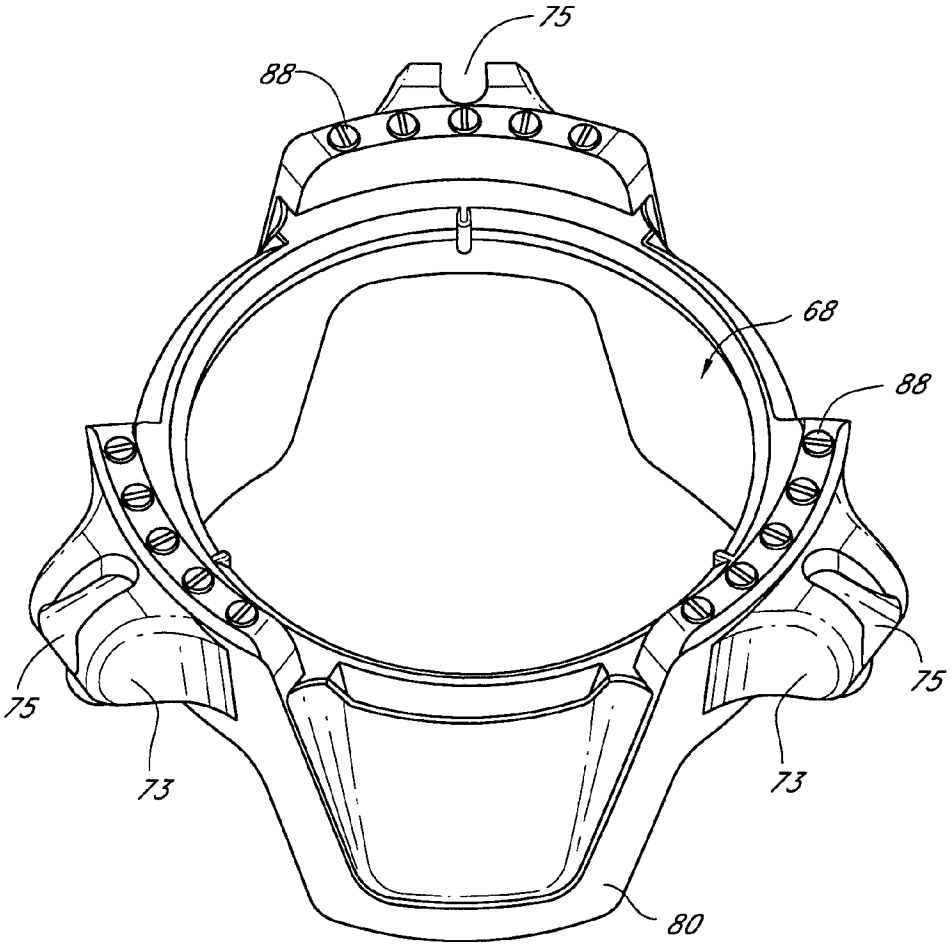
FIG. 7 is an enlarged perspective view of a quick release mechanism collar used in the flashlight of FIG. 1 or FIG. 3.

With reference to FIG. 7, the illustrated collar 68 comprises three finger pads 80 that are used to move the collar 68 in a downward direction against the force of the spring 70. Any other number of finger pads can be provided. Moreover, while the illustrated finger pads are shown in a generally symmetrical configuration, the finger pads can be asymmetrically arranged in some less desired configurations. The illustrated finger pads 80 have an open center such that fingers of a user can be more securely received within the illustrated finger pads 80. In some embodiments, however, the finger pads 80 can have a central recess rather than a central opening. In other embodiments, a rib, ridge or the like can be provided such that a user can get a sufficient grip on the collar 68 to allow the desired movement of the collar 68. Other suitable structures also can be used.

The collar 68 also preferably comprises a plurality of mounting bosses 73. The mounting bosses 73 extend radially outward from the illustrated housing 14. In the illustrated arrangement, one mounting boss 73 is positioned between each consecutive pair of finger pads 80. Thus, three mounting bosses 73 are provided in the illustrated arrangement. Any other suitable number of mounting bosses 73 can be provided and the mounting bosses can be symmetrically or asymmetrically arranged. In one configuration, the mounting bosses 73 can be received within recesses or openings formed in the collar 68 and secured therein with screws 88 or the like. In another configuration, the mounting bosses 73 can be integrally formed with the balance of the collar 68. In some configurations, screws or a screw-type pattern can be provided as decoration where, for example, the collar 68 is manufactured from one piece of material not requiring assembly of the mounting bosses 73 to the collar 68.

The mounting bosses 73 preferably comprise a holding structure 75, such as a slotted configuration which is shown in the illustrated arrangement. In one preferred arrangement, the connecting arms are slip-fit, snap-fit or friction-fit into the holding structure 75 of the mounting bosses 73. Other suitable connection techniques can be used, including, but not limited to, physically interlocking structures, threaded fasteners such as nuts and bolts, for instance, and the like. The holding structure 75 cooperates with the connecting arms 72 to secure the connecting arms 72 to the collar 68 for movement in a generally axial direction of the flashlight 10. In other words, the holding structure secures the connecting arms 72 to the collar such that movement of the collar 68 results in corresponding movement of the connecting arms 72, as will be described below.

Figure 8:
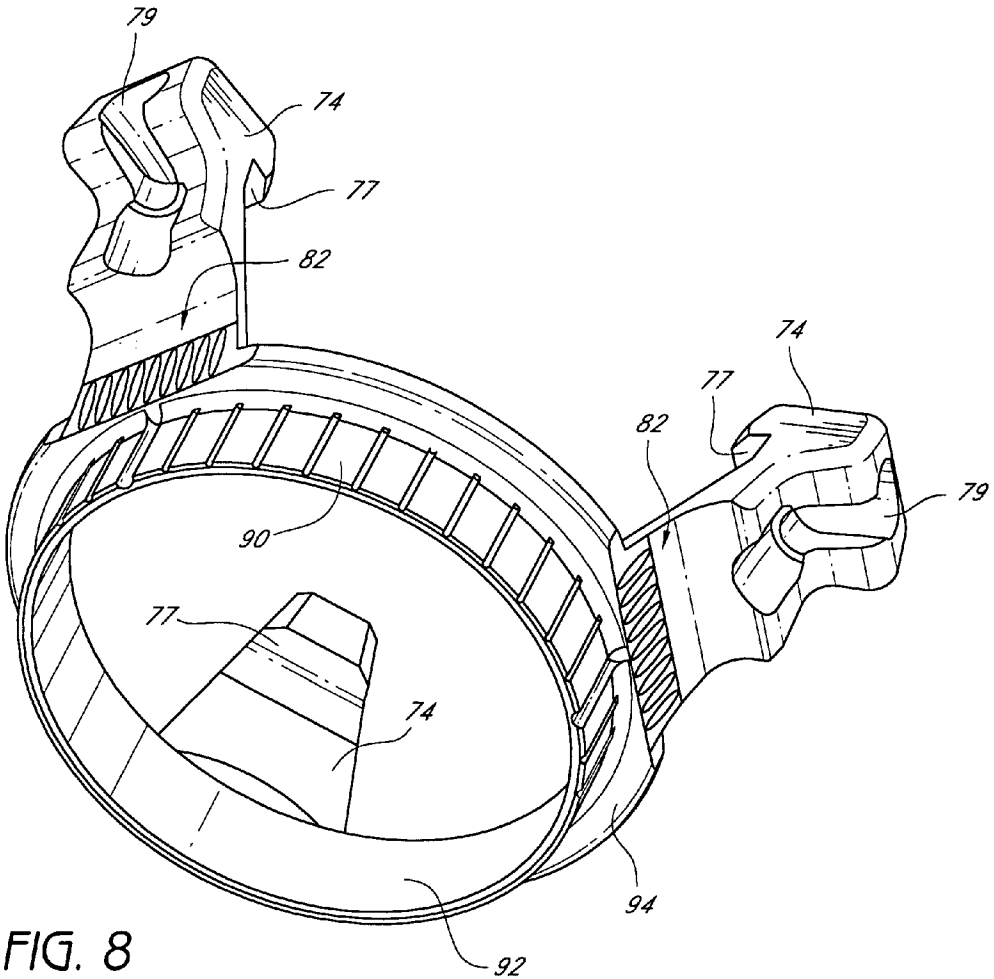
FIG. 8 is an enlarged perspective view of a quick release mechanism ring used in the flashlight of FIG. 1.

With reference to FIG. 8, the clamps 74 are hinged to a supporting structure that can be attached to the elongated housing 14. The supporting structure can be a ring 90. The ring 90 has an inner surface 92 that surrounds the elongated housing 14 and can securely fasten the ring 90 to the elongated housing through a press fit, for instance. The ring 90 can also be secured to the elongated body through an edge 94 that makes contact with, and rests upon, a receiving edge (not shown) on the elongated body 14. Other suitable techniques for securing the ring 90 to the housing 14 also can be used. The ring 90 can be made out of a resilient material such as, but not limited to, a plastic material.

The clamps 74 can be connected to the ring 90 through flexible members or hinges 82 (see FIG. 8). In other words, the clamps 74 can be integrally formed with the supporting structure and can have a portion that is flexible enough to allow deflection of the clamps 74. Hence, use of a resilient material is desired. In other embodiments, an actual hinge can be used to join the clamps 74 to the supporting structure.

The clamps 74 generally comprise an inwardly extending ridge 77 and an outwardly extending holding structure 79. The holding structure 79 of the clamps 74 can be configured similarly to the holding structure 75 of the mounting bosses 73. In such a configuration, the connecting arms 72 can be securely attached to the clamps 74. Thus, downward movement at the connecting arms 72 can result in radial movement of the ridge 74 away from an axial center of the flashlight 10 or the housing 14.

A clamping edge 78 (FIG. 3) is positioned on the bulb housing 26 to allow the ridge 77 of the clamps 74 to securely attach themselves to the clamping edge 78. When the clamps 74 are securely attached to the bulb housing 26, a tight fit results between the bulb housing 26 and the elongated housing 14. If desired, a seal, such as an o-ring or the like, can be provided at the interface between the bulb housing 26 and the elongated housing 14. Other sealing configurations can be used if a water-tight or water-resistant construction is desired.

Figure 9:
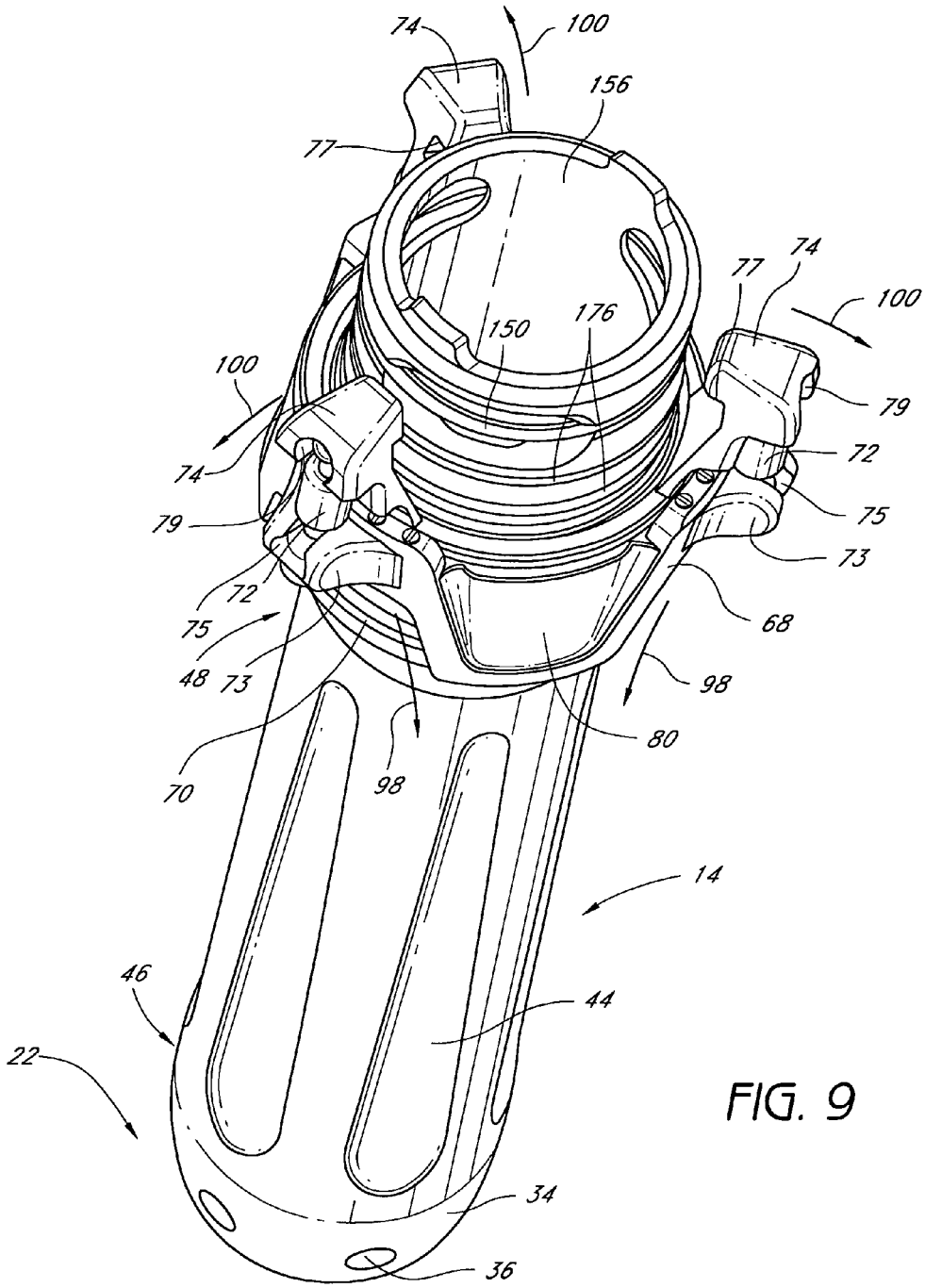
FIG. 9 is another side perspective view of flashlight of FIG. 1 with the quick release mechanism shown in an assembled state.

With reference to FIG. 9, the elongated housing 14 is shown in an open position. The operation of the quick release mechanism 40 is illustrated through various arrows and will now be described in detail. When the user wishes to open the bulb housing 26 (FIGS. 1-3), the user moves the finger pads 80 on the collar 68 in a downward direction as illustrated by arrows 98 against the force of the spring 70. The connecting arms 72 attached to the mounting bosses 73 transmit the downward force to the clamps 74. The ring 90 is securely positioned on the housing 14. Thus, the hinges 82 connected to the clamps 74 transfer the axial downward force of the connecting arms 72 to a radial force moving the clamps 74 in outward direction as illustrated by arrows 100. This movement of the clamps 74 in the outward direction 100 allows the bulb housing 26 to be easily opened.

When the user wishes to close or attach the bulb housing 26, the user moves the finger pads 80 on the collar 68 in a direction illustrated by the arrows 98 against the force of the spring 70. The hinges 82 connected to the clamps 74 transfer the downward force of the connecting arms 72 to a side force moving the clamps 74 in outward direction as illustrated by the arrows 100. This movement of the clamps 74 in an outward direction 100 allows the bulb housing 26 to be easily reattached. When properly attached, finger pads are released and the clamps 74 secure themselves to the collar 68.

The bulb housing 26 can also be reattached to the elongated housing by pressing the bulb housing 26 onto the elongated housing 14 without moving the finger pads 80. When the bulb housing 26 is reattached without moving the finger pads 80 in the direction 98, the clamps 74 will retract in the direction 100 against the force of the spring 70 when contacting the collar 68. After the clamps 74 have reached a position to secure the bulb housing 26, the force of the spring 70 will move the clamps into a position that secures the collar 68 and therefore the bulb housing 26.

Figure 10B:
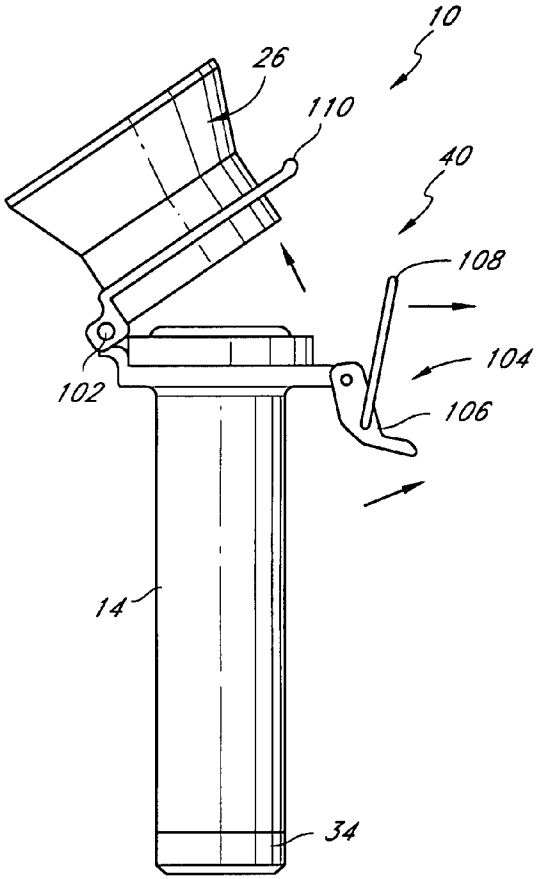
FIGS. 10*a* and 10*b* are side views of another LED flashlight that is arranged and configured in accordance with certain features, aspects and advantages of another preferred embodiment of the present invention.
Figure 10A:
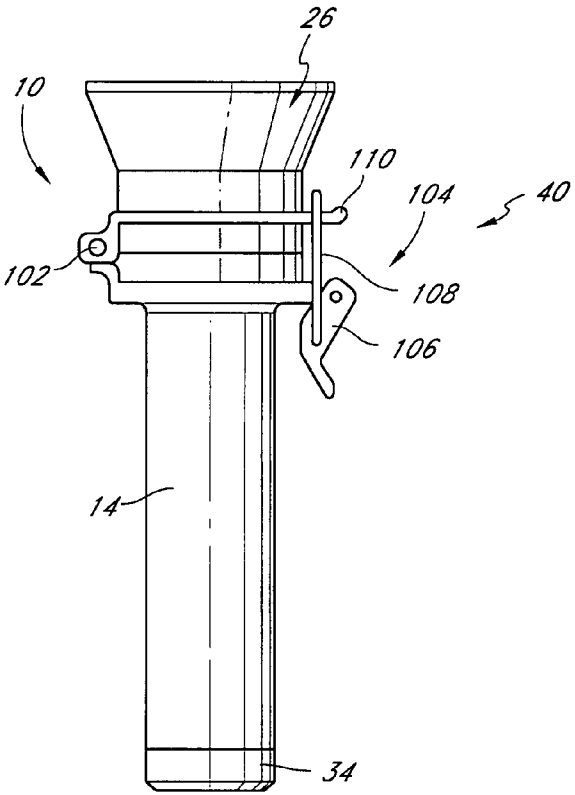

FIGS. 10*a* and 10*b* illustrate another embodiment of a quick release mechanism. In the preferred embodiment, the bulb housing 26 can rotate about a hinge 102 between an open and closed position. The LED flashlight 10 includes a latch 104 that can secure the bulb housing 26 in a closed position (FIG. 10*a*) or be positioned so as to allow the bulb housing 26 to be opened (FIG. 10*b*). The latch 104 comprises a lever 106 hinged to the elongated body 14. Attached to the lever 106 is a loop 108 that grabs an arm 110 and pulls down on the arm 110 to secure the bulb housing 26 in a closed position. To open the bulb housing 26, the lever 106 is moved in a direction that moves the loop 108 upward and away from the arm 110. In an upward position, the loop 108 releases the arm 110 and the bulb housing 26 can be opened. The quick release mechanism illustrated on FIGS. 10*a* and 10*b* allows the batteries 30 to be removed and replaced quickly and easily.

Figure 11B:
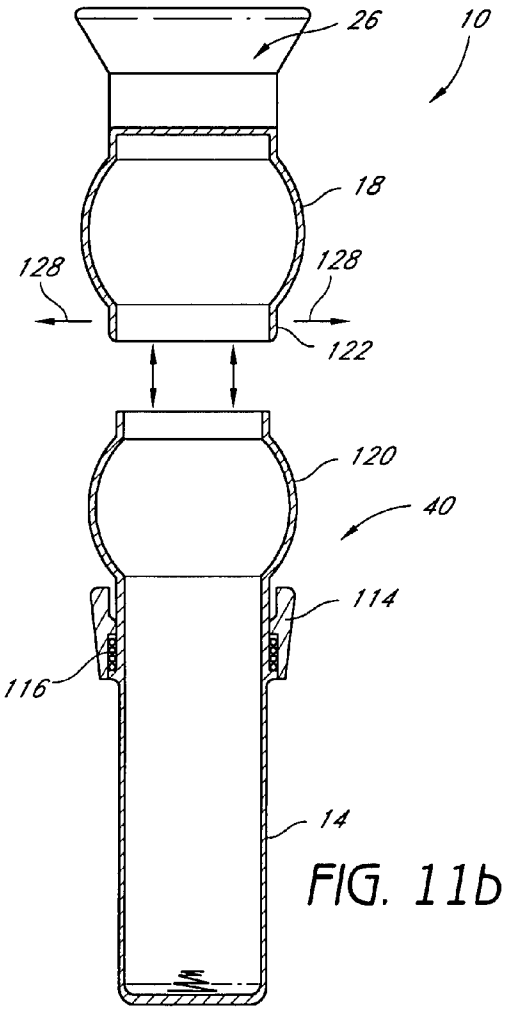
FIGS. 11*a* and 11*b* are side views of another LED flashlight that is arranged and configured in accordance with certain features, aspects and advantages of another preferred embodiment of the present invention.
Figure 11A:
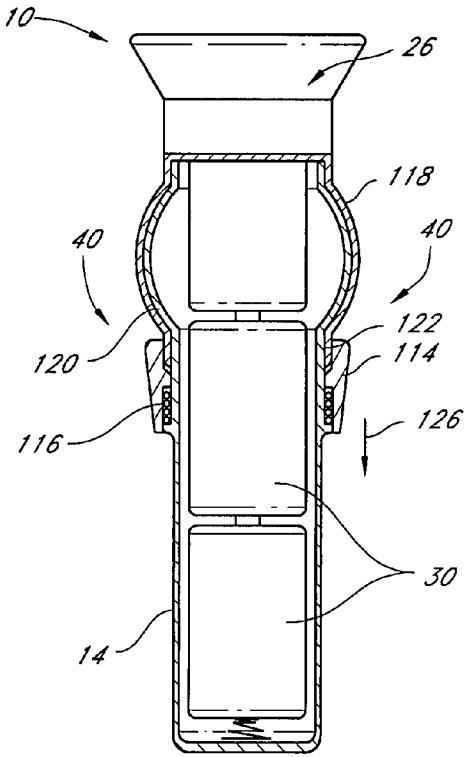

With reference to FIGS. 11*a* and 11*b* another embodiment of a quick release mechanism is shown. In the illustrated embodiment, the bulb housing 26 can be removed to reveal an open position (FIG. 11*b*) or the bulb housing 26 can be attached in a closed position (FIG. 11*a*). A flexible member 118 can be the general shape of a spherical form that matches a similar spherical housing 120 of the elongated tubular housing 14. The matching spherical form of the flexible member 118 and the spherical housing 120 allows the flexible member 118 and the spherical housing 120 to advantageously fit together. Other complementary geometry also can be used.

The illustrated embodiment includes a release mechanism 114. The release mechanism 114 comprises a spring 116 that is used to secure a rim 122 of the flexible member 118 in position along the housing 14. The spring 116 biases the release mechanism 114 into an upward position. When the bulb housing 26 is attached to the elongated housing 14 in a closed position, a collar of the release mechanism 114 surrounds the rim 122 of the flexible member 118. When the release mechanism is moved away from the rim 122 in the direction illustrated by an arrow 126 the flexible member 118 can expand in the direction illustrated by arrows 128 and allowing the bulb housing 26 to be removed from the elongated housing 14.

Figure 12B:
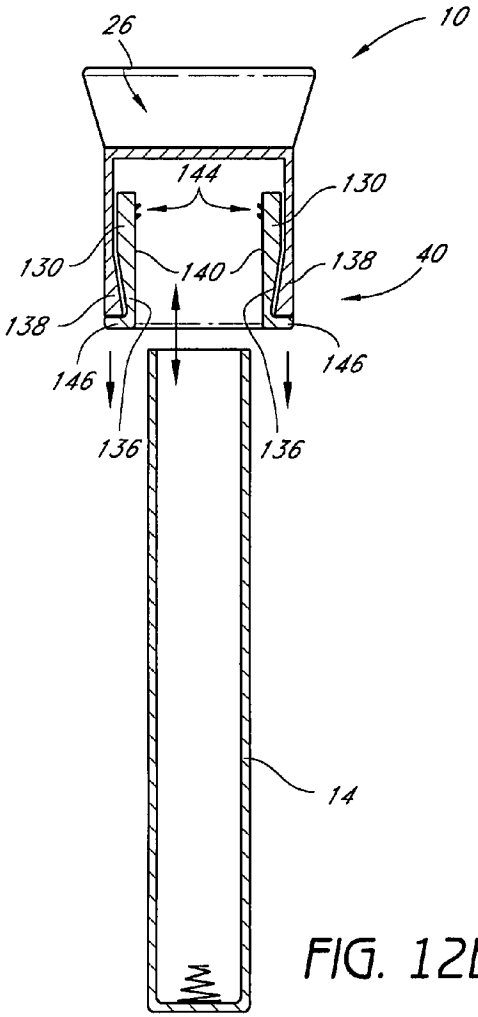
FIGS. 12*a* and 12*b* are side views of another LED flashlight that is arranged and configured in accordance with certain features, aspects and advantages of another preferred embodiment of the present invention.
Figure 12A:
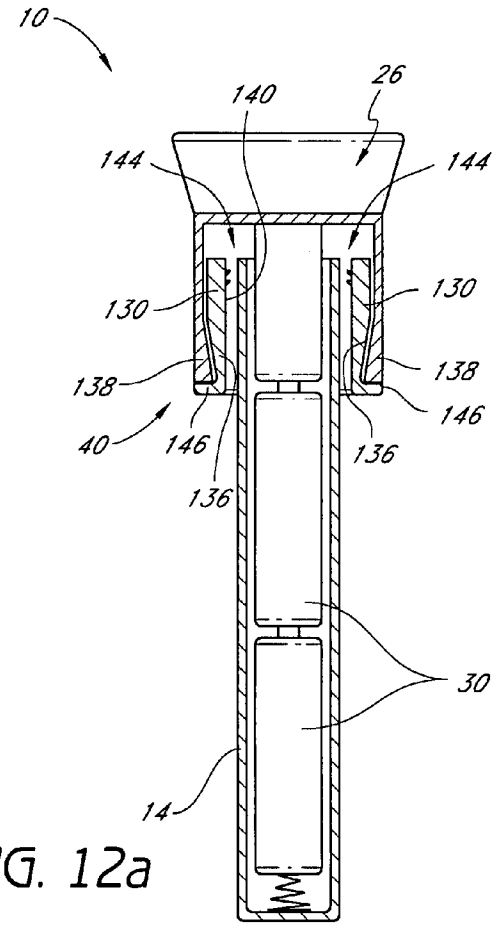

FIGS. 12*a* and 12*b* illustrate yet another embodiment of a quick release mechanism. In the illustrated embodiment, the bulb housing 26 can be removed to reveal an open position (FIG. 12*b*) or the bulb housing 26 can be attached in a closed position (FIG. 12*a*). A collar 130 and the bulb housing 26 together form an assembly 132. The collar 130 incorporates a wedge 136 that corresponds to a similar wedge 138 of the bulb housing 26. An inner surface 140 of the collar 130 also incorporates at least one rib 144 that grabs the elongated body 14 when the collar 130 is pressed inward toward the elongated housing 14.

When the bulb housing 26 is placed onto the elongated tubular housing 14, the collar 130 is pushed in a direction away from the elongated housing 14 until the collar is stopped by a lip 146. The bulb housing 26 stays in the closed position illustrated in FIG. 12*a* through the friction between the ribs 144 and the elongated housing 14. If the bulb housing 26 is pulled in the direction away from the elongated housing 14, the wedge 138 of the bulb housing 26 pushes against the wedge 136 of the collar 130. When the wedge 138 of the bulb housing 26 pushes against the wedge 136 of the collar 130, the ribs 144 press into the elongated housing 14 inhibiting the bulb housing 26 from being removed from the elongated housing 14. When the bulb housing 26 is to be removed from the elongated housing 14, the collar 68 itself is pushed into the bulb housing 26. The collar 68 being pushed into the bulb housing 26 causes the wedge 136 of the collar 130 to lose contact with the wedge 138 of the bulb housing 26 allowing the ribs 144 to lose contact with the elongated housing 14. The lack of contact of the ribs 144 with the elongated housing 14 allows the bulb housing 26 to be easily and quickly removed from the elongated housing 14.

While a few embodiments of quick release mechanisms have been shown and described, other suitable quick release mechanisms also can be used. For instance, arrangements similar to those used in the mechanical arts to form quick connect couplings for air hoses and the like can be used. Moreover, in one embodiment, a structure similar to a lure lock can be used.

With reference now to FIG. 13, a mechanism can be provided in the flashlight 10 to slow or control a rate of movement of the batteries when the batteries are being removed from the flashlight. Thus, in some embodiment of the present invention, the flashlight comprises a battery release control mechanism 148. The mechanism 148 preferably inhibits the batteries from exiting the flashlight 10 too rapidly during battery removal. The battery slow release mechanism 148 can include a slow release o-ring 150 that is positioned within a groove 152 that is incorporated into an exterior of the elongated housing 14. Elongated holes 154 are present in various positions along the groove 152 that allow the slow release o-ring 150 to extend into and through at least a portion of the elongated holes 154. The inward protrusion beyond the inner surface 156 of the elongated body 14 allows the o-ring 150 to partially contact the batteries during removal of the batteries. The part of the o-ring 150 that is positioned within the elongated holes 154 comes in contact with the batteries 30 and causes friction between the slow release o-ring 150 and the battery 30. The friction between the slow release o-ring 150 and the battery 30 causes the battery to enter and exit the elongated housing 14 more slowly than would otherwise occur. Other suitable forms of slow release mechanisms also can be used. For example, a rubber or rough surfaced sleeve can be positioned inside the elongated housing 14 or along any surface that provides a predetermined amount of friction between the inner surface 156 and the battery surface. Moreover, a plurality of friction-increasing components can be positioned within the throat of the housing 14 such that the components can contact the batteries during insertion and removal of the batteries. For instance, three strips of friction-increasing material can be provided along the inner wall 156 of the housing 14. In some configurations, friction-inducing pegs, posts, or nubs can extend into the opening through which the batteries will pass.

Figure 14:
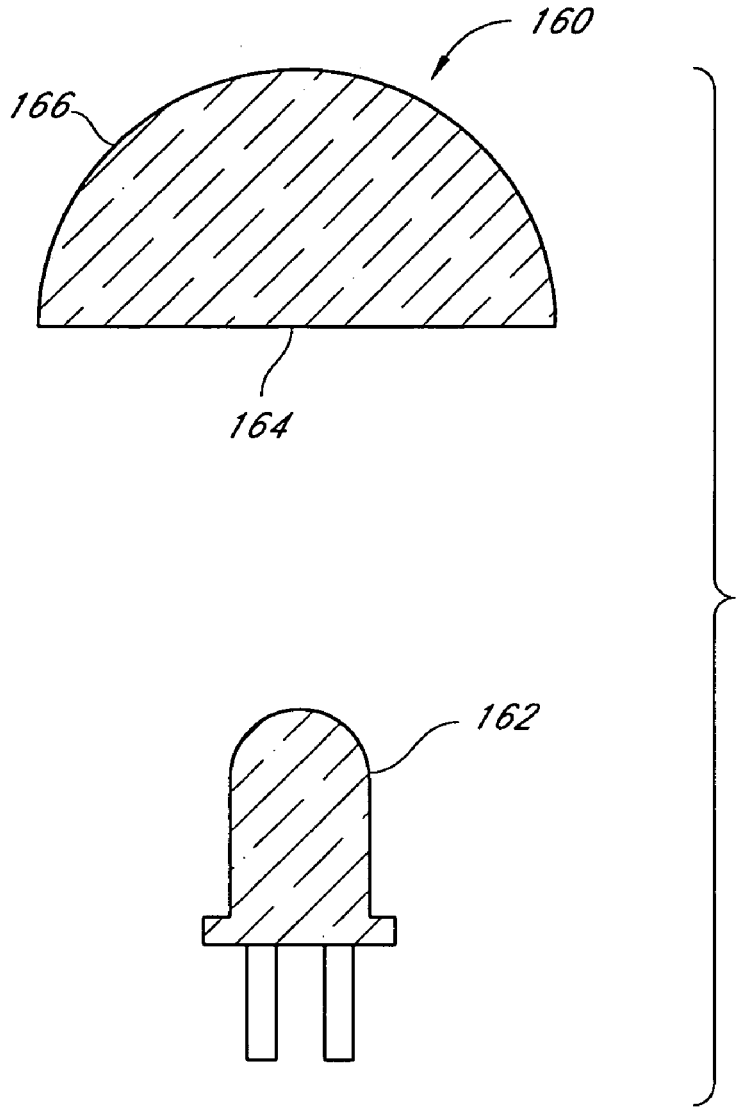
FIG. 14 illustrates an LED and a semicircular convex lens of the LED flashlight configured to channel light emitted from the LED.

With reference to now FIG. 14, a lens configuration is illustrated that is arranged and configured in accordance with certain features, aspects and advantages of an embodiment of the present invention. The lens configuration, while being described in the context of the flashlight 10, can be used for most any other LED-based lighting solution. For instance, the lens configuration can be used for tail lamp assemblies, stoplight assemblies, signage, headlamps, fixed lighting sources and the like.

As illustrated in FIG. 14, a half-spherical lens 160 can be positioned above an LED 162. While illustrated with the lens 160 located directed above the LED 162, the alignment does not necessarily require exact precision and the LED 162 can be moved slightly to the left or right in the figure. Where a single LED is used in a flashlight, the alignment preferably is more directly aligned. In a multiple LED configuration, however, a slight misalignment is preferred to allow the light to be directed slightly off-axis. For instance, a slight offset will allow six separate beams to more rapidly overlap to create a stronger beam with less dark spots.

Figure 15:
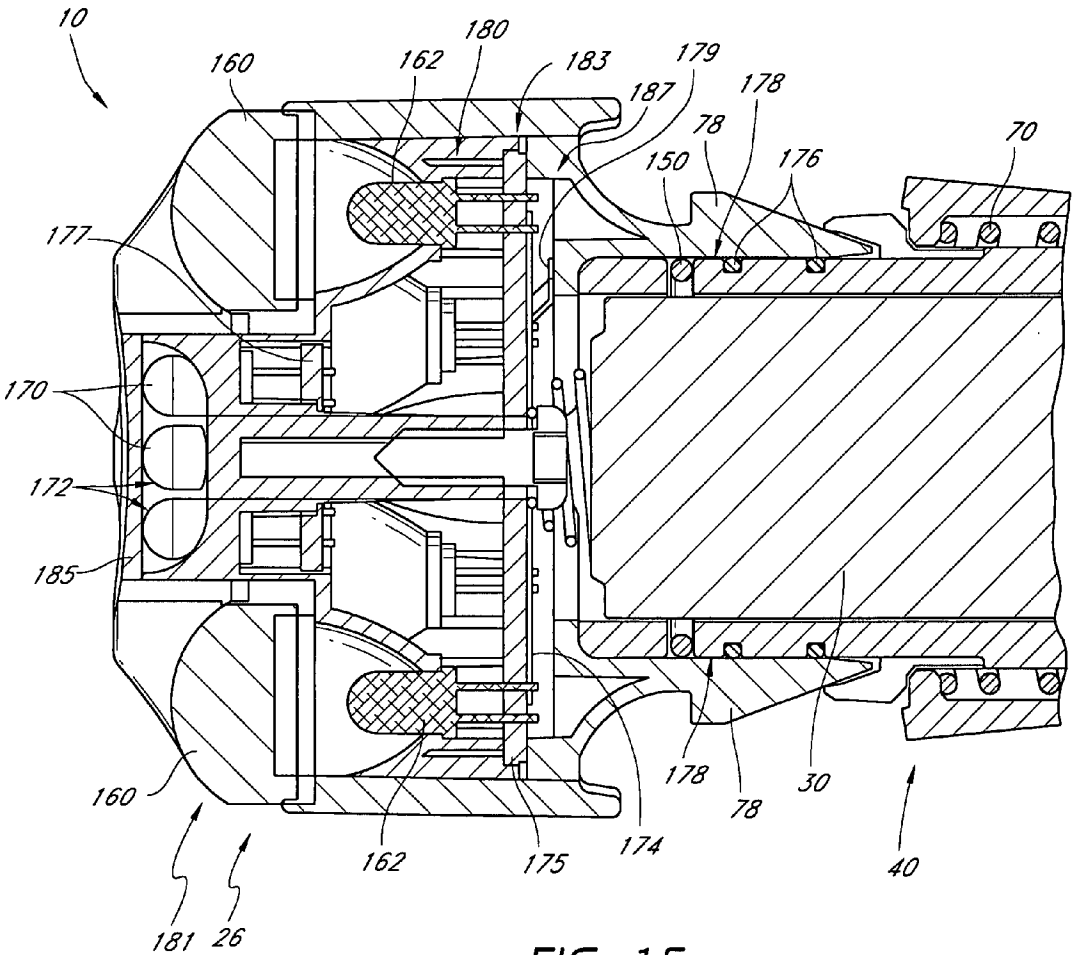
FIG. 15 is an enlarged side sectional view of a plurality of wide beam lenses and narrow beam lenses contained within a housing of the flashlight that can be used with the flashlight of FIG. 1 or FIG. 3.

As shown in FIG. 15, the lens 160 and the LED 162 can be located in the bulb housing 26 of the flashlight 10. The half-spherical lens 160 comprises a generally flat side 164 that faces the LED 162. Thus, light from the LED 162 will enter generally flat side of the half-spherical lens 160. The half-spherical lens 160 also comprises a curved side 166 that curves outward away from the LED 162 (convex lens) and where refracted light exits the half-spherical lens 160. The half-spherical lens 160 advantageously refracts the light from the LED. The half-spherical lens 160 enhances the light output of the LED 162 by directing the light in a predetermined direction. The half-spherical lens 160 contributes to an increased area of illumination including a longer distance of illumination. In some configurations, such a construction provides a "high" beam, which can provide a coverage of about 200 feet. It has been determined that somewhat less than a half sphere can be used with diminishing advantages that roughly correspond to the decrease in the amount of the sphere used. In some embodiments, the lens can be somewhat egg-shaped. In some configurations, the lens can be completely spherical. One also can add various structures to the flat side of the half-spherical lens 160 to pipe light to the lens 160 or to increase the axial length of the lens. Advantageously, the use of a LED in conjunction with the lenses described herein generally produces sufficient light for use in a lighting application without the need for a chromed reflector that is normally associated with flashlights.

With reference now to FIG. 15, a plurality of half-spherical lenses 160 are shown with respect to various LED's 162. The position of the LED's 162 with respect to the half-spherical lens 160 promotes a focused beam of light. The focused beam of light facilitates illumination for great distances with a coherent beam of light. As illustrated, a plurality of LED's 162 are positioned within the bulb housing 26. As illustrated in FIGS. 1 and 3, the LED's 162 and the associated lenses 160 preferably are spaced around the axis of the bulb housing 26. More preferably, the LED's 162 and the associated lenses 160 are spaced generally symmetrically about the axis.

Another set of LED's 170 promote wide-angle illumination. In some configurations, the wide-angle illumination will provide coverage of about 25 to about 30 feet. The second set of LED's 170 does not have the same type of lens as the first set of LED's 162. The second set of LED's 170 preferably transfer light through an LED housing 172 and refract light depending the design of the LED housing 172. In some embodiments, the LED's 170 can transfer light through an additional lens to alter the diffusion of light emitted by the LED's. FIG. 15 illustrates an example of the LED's 170 transferring light without the additional lens so the light is not refracted and therefore illuminates a wider area.

A plurality of rubber o-rings 176 can also be seen in FIG. 15 that act as gaskets that seal an opening 178 between the bulb housing 26 and the elongated housing 14. The O-rings 176 advantageously reduce the likelihood of infiltration of water into the elongated housing 14. Such an arrangement greatly improves the protection of the batteries, circuit boards and the like from water, liquids, dust and mud, for instance. Other suitable sealing configurations and constructions also can be used. Moreover, in one particularly advantageous arrangement, the flashlight is constructed in such a manner that the flashlight is substantially waterproof to a depth of about 50 ft and the flashlight is constructed to be submersible. In an even more advantageous arrangement, the flashlight is general float resistant.

Figure 16:
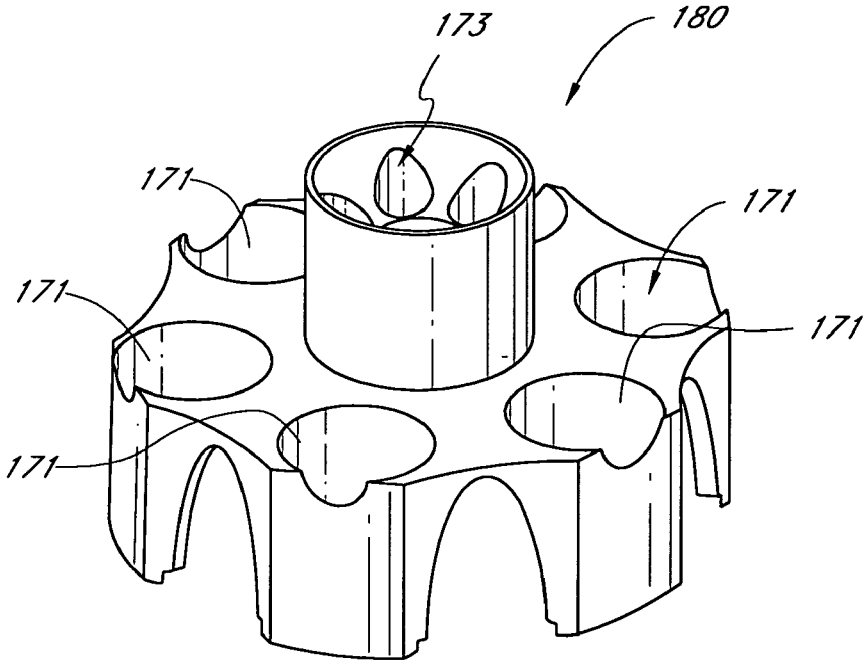
FIG. 16 illustrates a housing that is configured to absorb light from the LED's and glow in the dark when the LED's are no longer illuminating, which housing can be used with the flashlight of FIG. 1 or FIG. 3.
Figure 17:
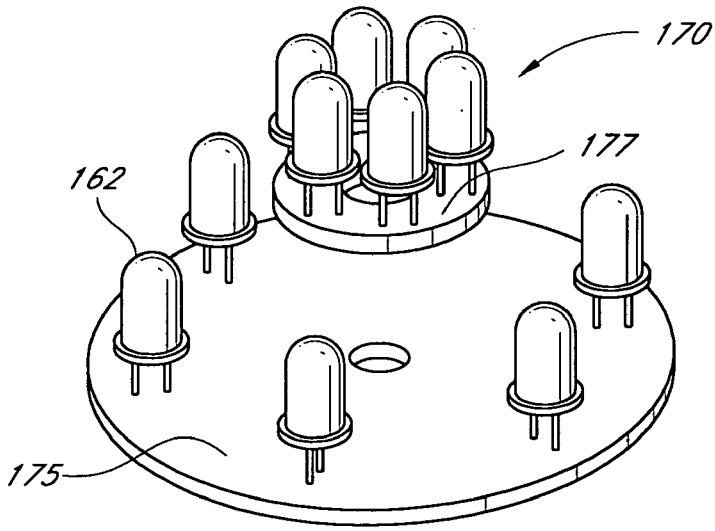
FIG. 17 is a perspective view of an LED assembly that can be used in the flashlight of FIG. 1 or FIG. 3.

With reference to FIGS. 16-20, a presently preferred bulb housing construction will be described in more detail. FIG. 16 illustrates a housing 180 that can be positioned on top of the LED's 162 and FIG. 17 illustrates the two sets of LED's 162, 170. In one arrangement, the housing 180 can be formed of glow-in-the-dark materials or can be coated with such materials. In another arrangement, portions of the housing 180 proximate one or more of the LED's can be made of such a material or coated with such a material. In the illustrated arrangement, at least the sockets 171 surrounding the LED's 162 and/or the sockets 173 surrounding the LED's 170 can be formed of, coated with or impregnated by glow-in-the-dark material. Advantageously, the glow in the dark material absorbs light from the LED's and is energized when the LED's 170, 162 are illuminated. Therefore, the glow in the dark material does not need to be energized from natural light since the LED's allow the glow in the dark material to be energized every time the multi lens LED flashlight is being used. When the LED's 170, 162 are not illuminated, the energized glow in the dark material can illuminate allowing the flashlight 10 to be easily located. Moreover, by positioning the glow-in-the-dark material behind the lens (e.g., on the same side of the lens as the LED), maximum effect from the glow-in-the-dark material can be obtained.

It should be noted that a similar positioning of one or more LED's proximate a glow-in-the-dark coated or impregnated material can be used in other contexts. For instance, a wall switch can be configured with an LED and a coated surface such that the switch can be located when the lights are off. In such a configuration, the LED can be periodically pulsed to increase the length of time during which the coated surface will glow.

Figure 23:
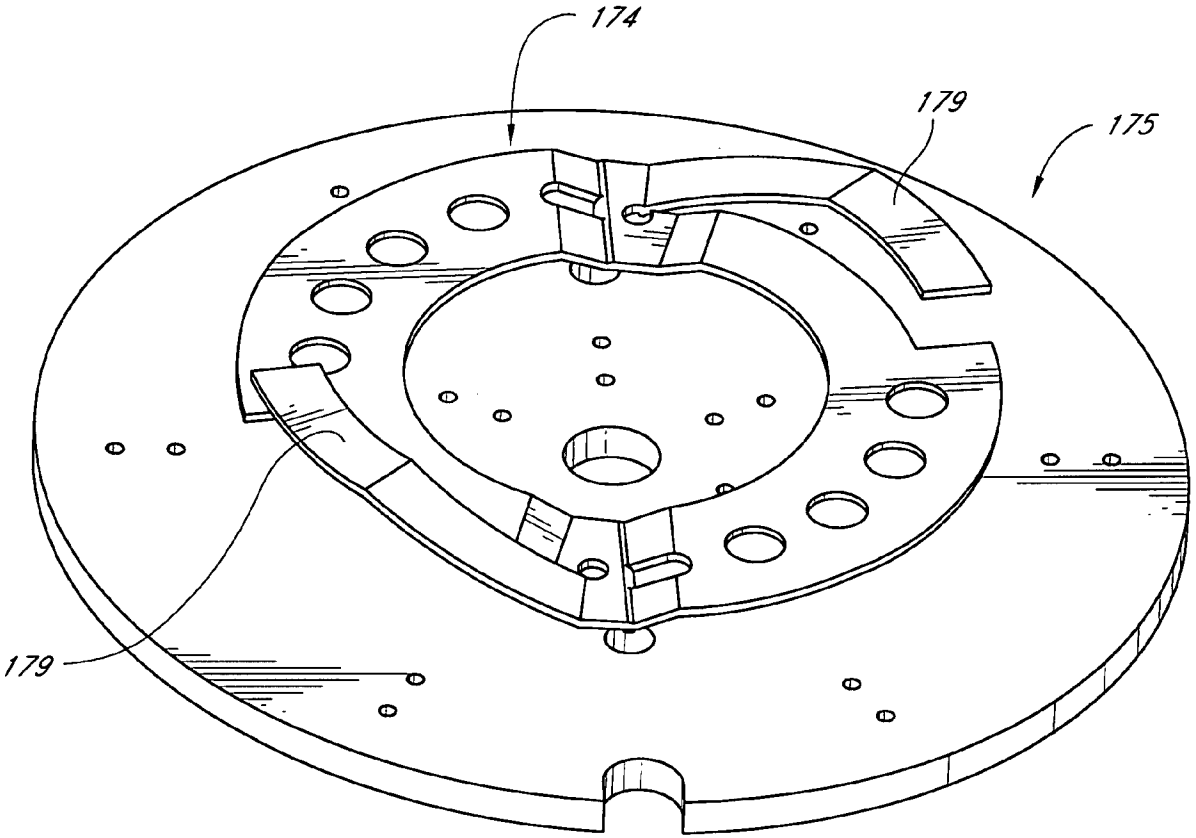
FIG. 23 illustrates a battery contact that is used with a circuit board contained within a flashlight that is arranged and configured in accordance with certain features, aspects and advantages of the present invention.

As illustrated in FIG. 17, each of the sets of LED's 162, 170 can be mounted to separate circuit boards 175, 177. With reference now to FIG. 23, the circuit board 175 preferably is provided with a battery contact 174. The battery contact 174 can be formed in any suitable manner and can be secured to the circuit board 175 in any suitable manner. In the illustrated arrangement, the battery contact comprises a pair of circuit springs 179 that are raised from the circuit board 175. In this manner, the circuit springs 179 have an increased surface area through which heat from the circuit board and the attached LED's can be dissipated because air can pass more surfaces of the battery contact than normally provided in most LED configuration. In some configurations, the circuit board 175 also can be provided with a contact point to the handle to allow the handle to assist in heat transfer away from the circuit board and the attached LED's. The raised circuit springs 179 provide a contact with a negative lead from the attached LED's.

The circuit boards 175, 177 can be operatively connected to the power source (e.g., the batteries 30) and a suitable switch such that the LED's 162, 170 can be selectively turned on and turned off. In one configuration, the switch is provided such that turning the bulb housing, or a portion thereof, will act to turn on and turn off the LED's. In a more advantageous configuration, the rotation of the bulb housing does not require two hands but only a slight brush with another body part or some other surface. Preferably, the circuit boards are sized and configured to be received within the housing 180. Thus, the circuit boards and the LED's can be positioned inside a recess of the housing 180.

In one configuration, the circuit boards comprise a solid-state digital voltage regulator that is used to control power output from the LED's. Through the use of the voltage regulator, three C cell batteries can provide over 15 hours of continuous operation of the LED's. Preferably, the circuit boards also contain circuitry that allows the LED's to be flashed when the battery power reaches a replacement level. Following flashing, the circuitry can be configured to reduce the power output to the LED's to a second setting, which will provide about 320 hours of continuous use before the batteries are unable to power the flashlight.

Figure 18:
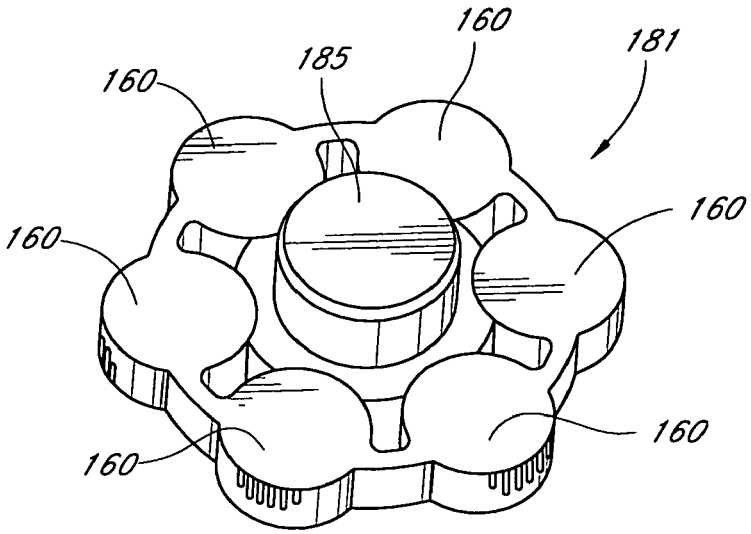
FIG. 18 is a perspective view of a lens assembly that can be used in the flashlight of FIG. 1 or FIG. 3.
Figure 19:
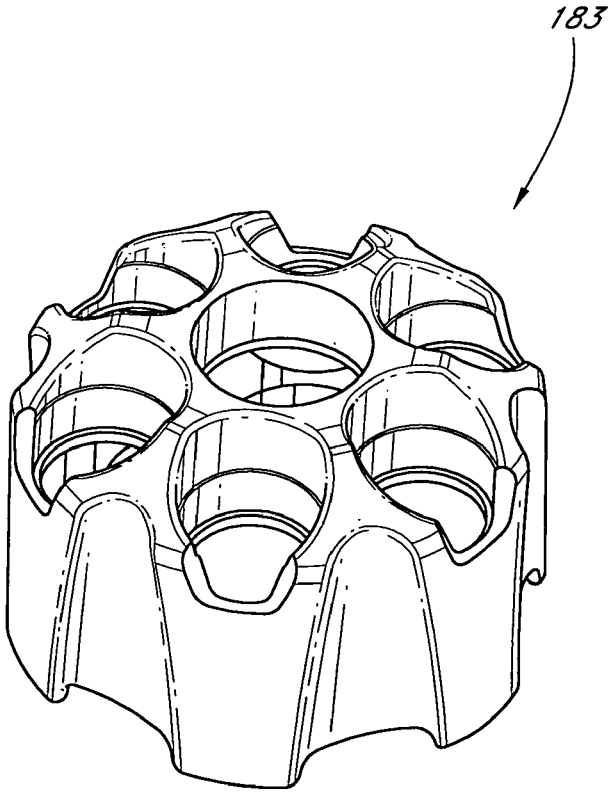
FIG. 19 is a perspective view of a bulb housing that can be used in the flashlight of FIG. 1 or FIG. 3.
Figure 20:
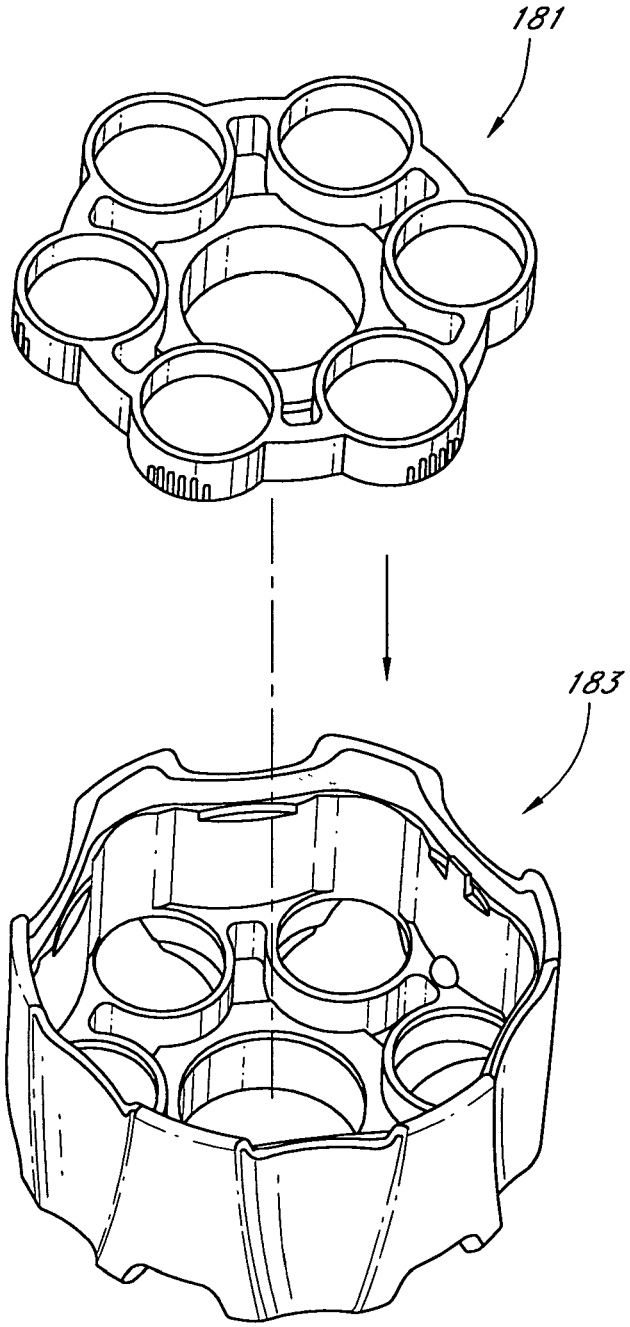
FIG. 20 illustrates that the lens assembly can be inserted into the bulb housing as a single component comprising a plurality of lenses.

With reference to FIGS. 18-20, the bulb housing 26 also comprises a lens assembly 181 and an outer shell 183. As illustrated, the lens assembly 181 advantageously comprises a plurality of lenses 160 such as those described above. The lenses 160 desirably are formed into an integrated component. The integrated lens assembly 181 simplifies assembly and improves the integrity of the flashlight 10. In particular, providing the integrated lens assembly 181 allows each of the LED's 162 to be associated with a single lens 160 while reducing the difficulty associated with sealing each lens and correctly orienting each lens 160 relative to the shell 183 and the LED 162.

In the illustrated lens assembly 181, a central cover 185 also is provided. The central cover preferably overlies the LED's 170. In some arrangements, the central cover 185 can be colored in a manner that does not significantly adversely impact light transmissivity. In the illustrated arrangement, both the central cover 185 and the plurality of lenses 160 are substantially clear.

An enhanced optical fluorescent pigment lens can be provided over the lenses or the lenses can be impregnated or coated with a fluorescent dye as desired. In some embodiments, the LED itself can be impregnated, coated or covered by the appropriate color. It is desired, however, that the lens actually contain the color rather than a filter because the filter can create a loss of light due to reflection at its surfaces and refraction internal to the filter. Thus, in preferred embodiments employing white-light emitting diodes (e.g., white or blue near UV), a colored dye can be impregnated into the lens assembly 181. The colored dye can control which light color is emitted by the lens assembly 181 and which color of light is absorbed by the lens assembly 181. In particular, if a yellow fluorescent dye is used to color the lens assembly 181, the blue light portion of the light emitted from the LED is absorbed (called the excitation light) while the emitted light is at longer wavelengths—greens, oranges, yellows, reds. The yellow filter blocks the blue and only lets the fluorescence through. Such a configuration advantageously produces a fog light having an amber-colored light stream that improves the operability of the flashlight in foggy conditions. It should be noted that fluorescent dyes/coatings in combination with a blue/white LED can be used in a number of other areas, including car lighting, boat lighting, street signs and the like. Moreover, it is believed that a yellow light is less likely to attack insects, which can reduce the number of insects struck during operation of a vehicle or which can reduce the number of insects attached while operating a flashlight equipped with the fluorescent lens assembly.

The shell 183 preferably is sized and configured to receive the housing 180. In other words, the housing 180 preferably is insertable into the shell 183. In some arrangements, the housing 180 is substantially clear. In other arrangements, the housing can be colored and can have any desired level of opacity. In some more preferred embodiments, the lens assembly 181 is inserted into the shell 183, as shown in FIG. 20, and the housing 180 is joined to the shell 183. Thus, the lens assembly 181 can be sealed to the shell 183 and the housing 180 can be sealed to the shell 183. For instance, the shell 183 and the housing 180 can be comolded together. The LED's 162, 170 can be inserted in to the sockets 171 of the substantially sealed chambers defined between the housing 180 and the lens assembly 181 within the shell 183. As explained above, such a configuration allows greatly enhanced protection of the LED's 162, 170 and the related circuit boards 175, 177 from moisture and other environmental debris.

As illustrated in the cross-section of FIG. 15, a lower shell member 187 preferably substantially captures the housing 180 between the shell member 183 and the lower shell member 187. The lower shell member can be formed of a colorized material or can be clear. Preferably, the lower shell member 187 is formed of a light transmissive material such that light from the LED's 162, 170 can be viewed from behind. More preferably, the lower shell member 187 can allow a user to view the glow-in-the-dark material used in the sockets or can be formed of, coated with or impregnated by glow-in-the-dark material such glow-in-the-dark material can be viewed from the back end of the bulb housing 26. Such a construction further enhances the ability to find the flashlight 10 in the dark when the LED's 162, 170 are not illuminated.

Figure 21B:
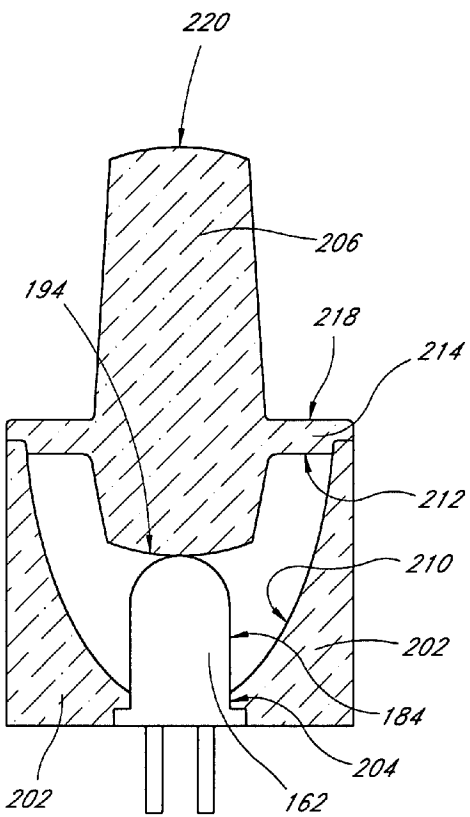
FIGS. 21*a* and 21*b* illustrate two piece lens assemblies that can be used in the flashlight of FIG. 1 or FIG. 3.
Figure 21A:
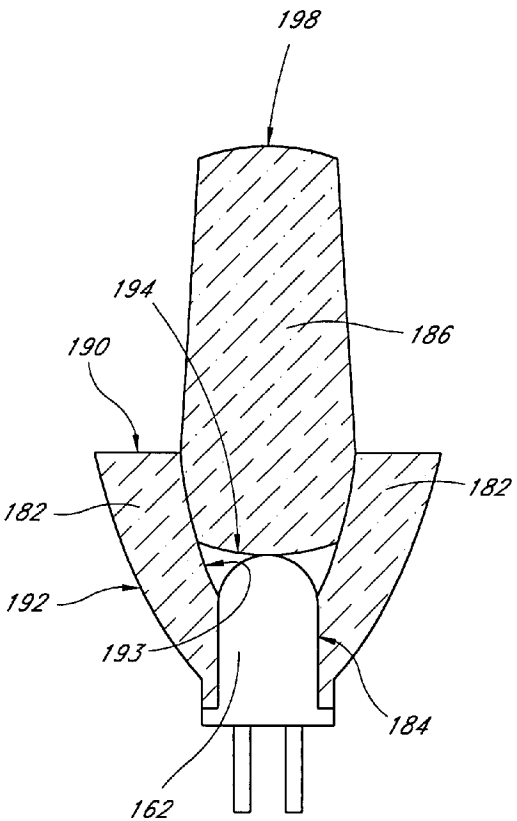

With reference now to FIGS. 21*a* and 21*b*, other lens configurations arranged and configured in accordance with certain features, aspects and advantages of the present invention are illustrated therein. While the lens configurations of FIGS. 21*a* and 21*b* can be used with the flashlights 10 described herein, the lens configurations also can be used in other environments, including those discussed above with respect to the lens shown in FIG. 14.

The lens configuration illustrated in FIG. 21*a* comprises a lower lens 182 that surrounds a side portion 184 of the LED 162 and secures the LED 162 in a fixed position relative to the lens configuration. The lower lens 182 preferably is a solid component that surround the LED 162. Light exits the LED 162 in all directions and is refracted by both the lower lens 182 and an upper lens 186. Light that leaves the LED 162 through the side of the LED 184 enters the lower lens 182 and advantageously is refracted toward a lower lens exiting surface 190 by a first lower lens surface 192 and a second lower lens surface 193. To improve performance, the first lower lens surface 192 and the second lower lens surface 193 can be chromed, coated or otherwise provided a surface treatment to further reduce the likelihood that light will emerge from these surfaces.

Light that exits the LED 162 in a generally upward direction (e.g., light emitted through a curved portion 194 of the LED 162) enters the upper lens 186 and is refracted towards an upper lens exiting surface 198 where it exits the flashlight 10. The light that is refracted by the upper lens 186 and exits the upper lens exiting surface 198 projects the light from the flashlight 10 in a concentrated area. Preferably, the upper lens exiting surface 198 comprises a portion of a spherical structure such that some similar benefits are achieved relative to the half-spherical lens discussed above. In some configurations, the upper lens 186 and the lower lens 182 are integrally formed (e.g., formed as a single component). In other configurations, only one of the upper lens 184 and the lower lens 182 is used and the other is omitted.

The light that is redirected by refraction by the lower lens 182 exits the lower lens exiting surface 190 and projects the light in a outward cone shape that illuminates a wider, less concentrated area. Meanwhile, the light emitted by the upper lens 186 is more concentrated and is emitted from within the outward cone shape projected by the lower lens exiting surface 190. Moreover, the upper lens 186 helps to focus the light such that the light from the LED is not overly washed out when viewed in bright sunlight. Thus, the two lens portions 182, 186 cooperate to somewhat amplify the light emitted from the lens assembly.

Another embodiment of a lens configuration is illustrated in FIG. 21*b* and comprises a lower lens 202 that surrounds a lower portion 204 of the LED 162 and secures the LED 162 in a fixed position relative to the lens assembly. Light exits the LED 162 in all directions and is refracted by both the lower lens 202 and an upper lens 206 in manners similar to the embodiment of FIG. 21*a*. The light that leaves the LED 162 through the side 184 of the LED 162 passes through an inner lens surface 210 of the lower lens 202 and is refracted toward an upper lens lower side surface 212. The light then passes through a side portion 214 of the upper lens 206 and exits the upper lens 206 through an upper lens upper side surface 218. The light exits the upper lens upper side surface 218 advantageously in the direction where the flashlight 10 is being pointed.

Light that exits the LED 162 through the curved portion 194 of the LED 162 generally enters the upper lens 206 and is refracted towards an upper lens exiting surface 220 where it exits the flashlight 10. The light that is refracted by the upper lens 206 and exits the upper lens exiting surface 220 projects the light from the flashlight 10 in a more concentrated area. The light that is refracted by the lower lens 202 and exits the upper lens upper side surface 218 projects the light from the flashlight 10 in a outward cone shape that illuminates a wider, less concentrated area in the direction where the flashlight 10 is being pointed. It should be noted that these lens assemblies can be used in various application.

Figure 22:
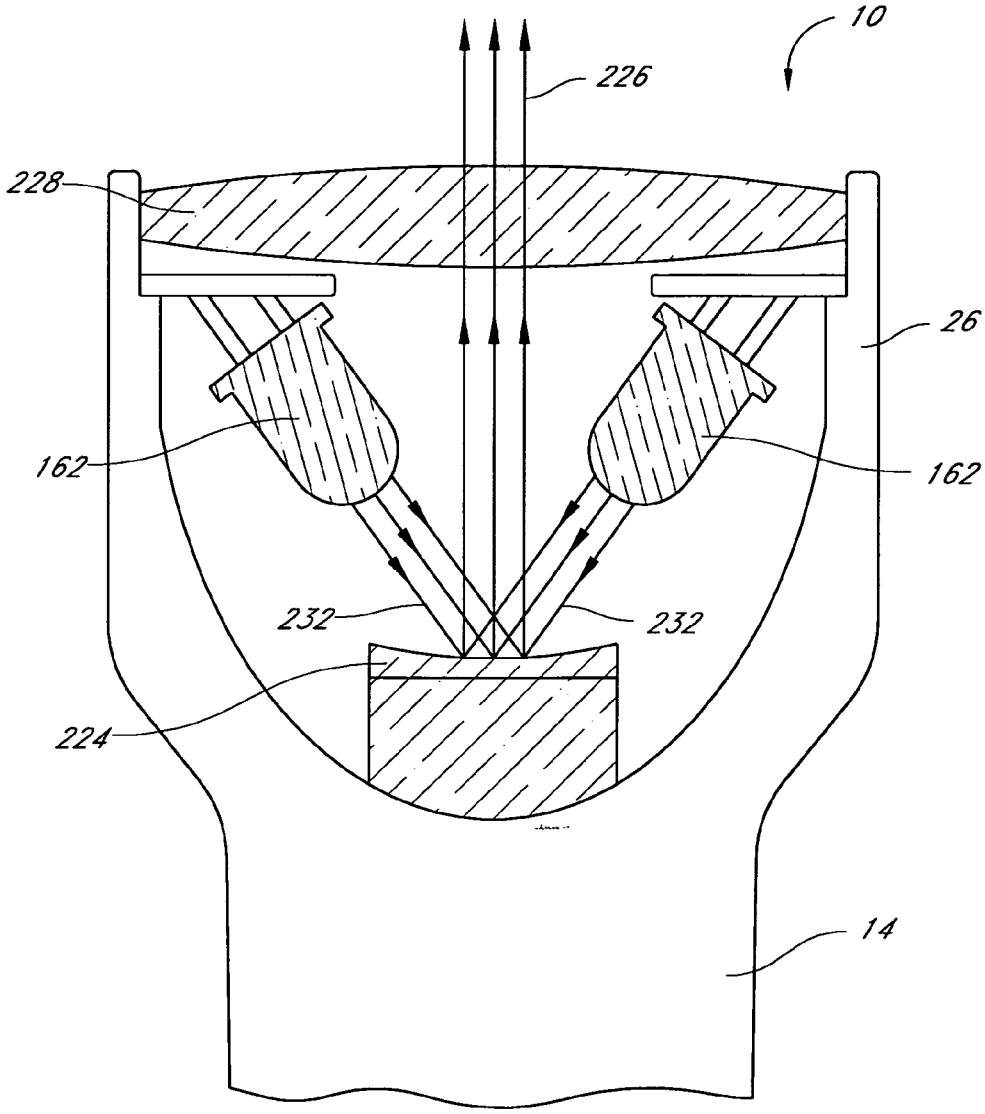
FIG. 22 illustrates an LED, reflector and lens configuration positioned in a bulb housing that can be used in certain embodiments of an LED flashlight arranged and configured in accordance with certain features, aspects and advantages of a preferred embodiment of the present invention.

With reference now to FIG. 22, another bulb housing 26 is shown in which another preferred embodiment of an LED and lens assembly is shown in the context of the flashlight 10. In the illustrated arrangement, a plurality of LEDs 162 can be angled downward toward a concave shaped reflector 224. The concave shaped reflector 224 allows multiple LEDs to be mounted in a compact area while providing a concentrated light beam 226. The concave shaped reflector 224 is advantageously mounted opposite a convex exiting lens 228. Light 232 exits each LED 162 and reflects at a predetermined angle toward the exiting lens 228. The convex shape of the exiting lens 228 shapes the reflected light beam 232 from the LEDs 162 and directs light wherever the flashlight 10 is pointed. Other lens designs are also possible that direct the reflected light 226 to illuminate wherever the flashlight 10 is pointed. Such a compact LED-mounting design allows the LED flashlight to be compact in size while providing very bright concentrated illumination.

Figure 24:
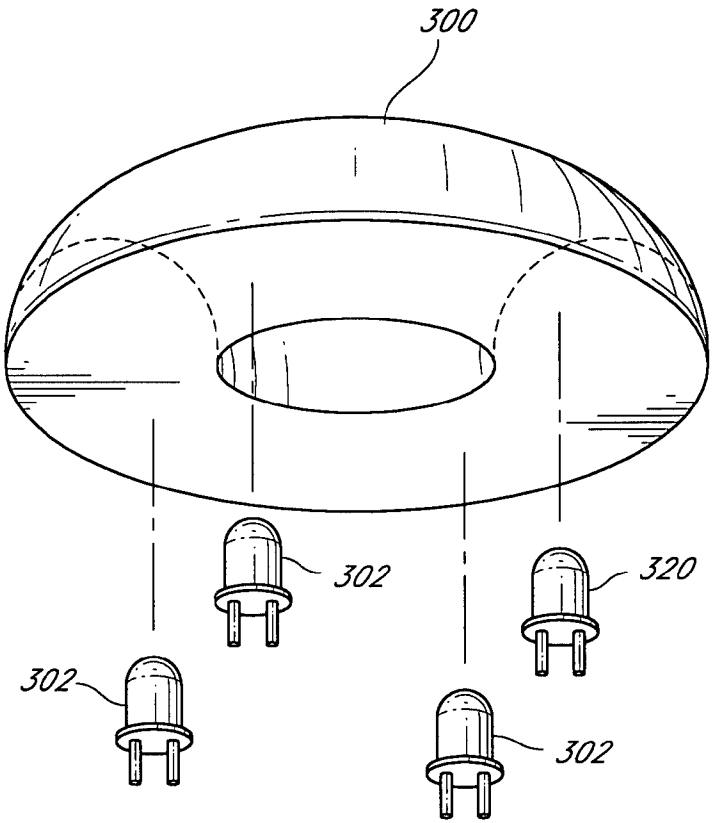
FIG. 24 is a half-toroid lens that can be used in accordance with certain features, aspects and advantages of the present invention.

With reference now to FIG. 24, a further lens configuration is illustrated therein. The lens 300 preferably has a half-toroidal configuration. In other words, the lens 300 preferably resembles a bagel slice. In this manner, the lens 300 has a semicircular cross-section similar to that of the half-spherical lenses discussed above. In some configurations, a cylindrical tube section can extend away from the rounded portion of the toroid such that a cylindrical tube having a toroidal top is created. In other configurations, a full toroid is provided. The lens 300 can be secured in a lens housing in any suitable manner and can be used to replace at least a portion of the lens assembly 181 described above.

Any number of LED's 302 can be provided along the circumference of the lens 300. The lens 300 advantageously allows an increased number of LED's 302 to be positioned under the lens when compared to the lens assembly 181 described above. The configuration of LED's 302 and the lens 300 results in a ring-shaped light when viewed at close range but a normal light beam when viewed at a distance.

Figure 25:
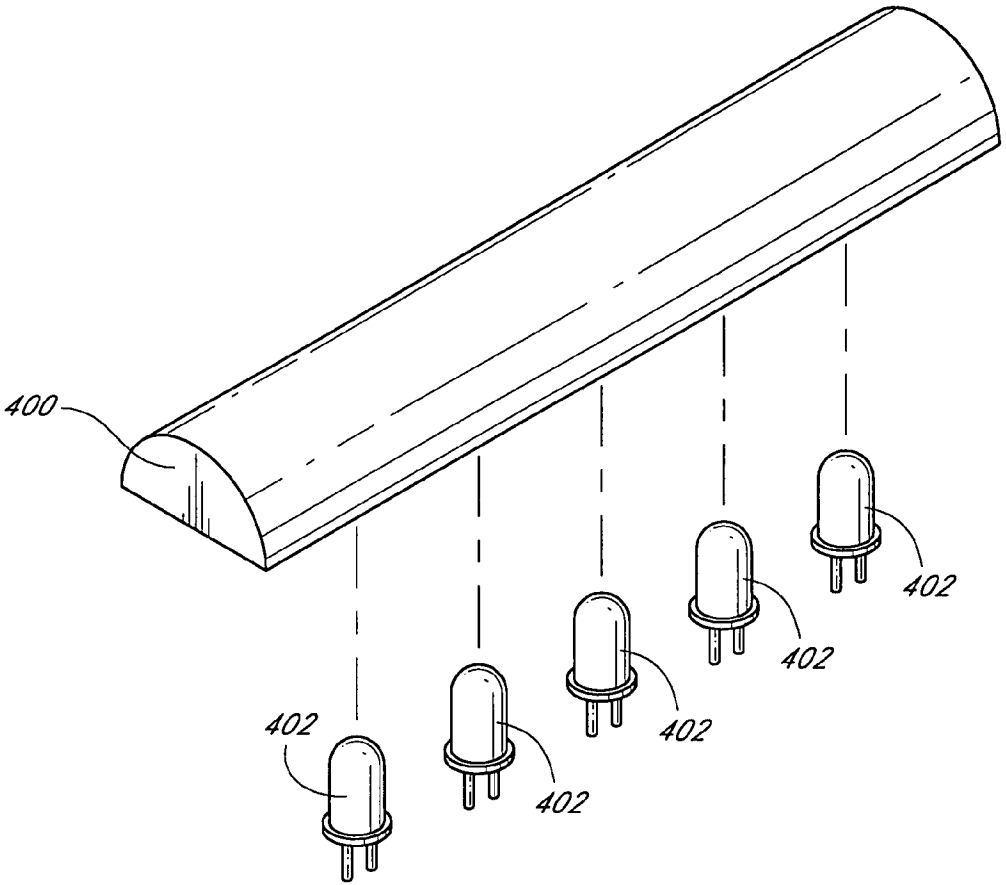
FIG. 25 is a half-cylindrical lens that can be used in accordance with certain features, aspects and advantages of the present invention.

With reference now to FIG. 25, another lens configuration is illustrated therein. As illustrated, the lens 400 is a have sphere pipe lens. In other words, the lens 400 is a cylindrical lens and, as such, preferably has at least a portion that has a cross-section in common with the lens 300 and the hemispherical lenses described above. While the illustrated lens 400 is generally straight, the lens can have curved portions or can be entirely curved. As with the lens 300 described above, any number of LED's 402 can be used in conjunction with the lens 400.

When configured in the manner shown in FIG. 25, the lens 400 provides a generally straight-line light projection. In other words, the light beam is generally rectangular. A shorter version of the lens 400 can be used on the flashlight described above in a manner similar to the lens assembly 181. In other configurations, the lens 400 can extend along the handle to provide a differing light beam alternative. For instance, rotating the handle and the associated lens could provide a sweep of a wide band of light.

Moreover, the lens 400 in combination with the LED's 402 can be used in a number of other application, including but not limited to vacuum cleaner lights, automotive lighting and other vehicular applications, accent lighting such as that used for under-cabinet lighting, wall art lighting, aquarium lighting and landscaping or architectural lighting. Other applications also can include, for instance but without limitation, outdoor sports venue lighting, medical applications and the like.

As described above, certain features of the present invention exploit the properties of multiple LED's used in combination with lenses that have a curved outer surface and a flat outer surface. In some configurations, the lenses are hemispherical. In other configurations, the lenses are half-toroidal. In yet other configurations, the lenses are a portion of a cylinder.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A multiple light LED flashlight comprising an elongate tubular housing and a bulb housing, a quick disconnect mechanism positioned between the tubular housing and the bulb housing, the tubular housing defining a chamber sized and configured to receive at least one battery, the quick disconnect mechanism adapted to provide access to the chamber by removal of the bulb housing from an end of the tubular housing, the bulb housing comprises an outer shell member and a lower shell member that are secured together, a housing is positioned within a region defined between the outer shell member and the lower shell member, a lens assembly is positioned generally between the housing and the outer shell member, the lens assembly comprising a plurality of lenses that are integrally formed and a plurality of LED's extending through a portion of the housing and being generally aligned with a respective lens of the lens assembly.

2. The flashlight of claim 1, wherein each of the plurality of LED's extend into a respective socket formed in the housing.

3. The flashlight of claim 2, wherein at least one of the sockets comprises a glow-in-the-dark material.

4. The flashlight of claim 1, wherein interfaces between the lens assembly and the outer shell member and interfaces between the outer shell member and the lower shell member are sealed.

5. The flashlight of claim 1, wherein a contact is partially embedded within a wall of the elongated tubular housing.

6. The flashlight of claim 1, wherein at least one of the plurality of lenses comprises a generally flat surface facing the respective LED and an opposing generally hemispherical surface.

7. The flashlight of claim 1, wherein the lens assembly further comprises a central cover.

8. The flashlight of claim 7, wherein a plurality of LED's are positioned proximate the central cover.

9. The flashlight of claim 1, wherein at least a portion of the lower shell member is formed of a light transmitting material.

10. The flashlight of claim 9, wherein the lower shell member is generally clear.

11. The flashlight of claim 10, wherein the lower shell member is generally colorless.

12. The flashlight of claim 1, wherein the tubular housing has a larger diameter portion and a smaller diameter portion with the smaller diameter portion being positioned between the larger diameter portion and the bulb housing.

13. The flashlight of claim 1, wherein the lens assembly comprises at least one lens selected from the group consisting of a semi-spherical lens, an elongate two piece lens in which an elongate lens is positioned at least partially within a ring-like lens and an elongate two piece lens in which an elongate lens rests on an outer surface of a ring-like lens.

14. The flashlight of claim 1 further comprising an end piece connected to said tubular housing, said tubular housing being positioned between said end piece and the bulb housing.

15. The flashlight of claim 14, wherein the end piece comprises a plurality of holes.

16. The flashlight of claim 15 further comprising a plurality of pins that connect the end piece to the tubular housing.

17. The flashlight of claim 16, wherein the pins extend beyond the end piece and define a plurality of protruding rod tips.

18. The flashlight of claim 16 further comprising a lanyard that is connected to at least one of the plurality of pins.

19. The flashlight of claim 1 further comprising a plurality of indented ribs extending in an axial direction along a portion of the tubular housing.

20. The flashlight of claim 1 further comprising a glow-in-the-dark portion that is positioned within the bulb housing on the same side of the lens assembly as the plurality of LED's.

* * * * *